US012767378B2

(12) United States Patent
Maldonado

(10) Patent No.: US 12,767,378 B2
(45) Date of Patent: Oct. 20, 2026

(54) MULTI-COMPARTMENT COLLAPSIBLE STORAGE CONTAINER

(71) Applicant: Deco(R)ative Homes L.L.C., Gloversville, NY (US)

(72) Inventor: Ivana Maldonado, Gloversville, NY (US)

(73) Assignee: DECO(R)ATIVE HOMES L.L.C., Gloversville, NY (US)

( * ) Notice: Subject to any disclaimer, the term of this patent is extended or adjusted under 35 U.S.C. 154(b) by 0 days.

(21) Appl. No.: 19/182,033

(22) Filed: Apr. 17, 2025

(65) Prior Publication Data

US 2026/0159266 A1 Jun. 11, 2026

Related U.S. Application Data

(63) Continuation-in-part of application No. 18/364,053, filed on Aug. 2, 2023, now Pat. No. 12,304,689.

(51) Int. Cl.

| | |
|---|---|
| ***B65D 1/22*** | (2006.01) |
| ***B65D 25/00*** | (2006.01) |
| ***B65D 25/06*** | (2006.01) |
| ***B65D 25/20*** | (2006.01) |

(52) U.S. Cl.

CPC ..... *B65D 1/225* (2013.01); *B65D 25/005* (2013.01); *B65D 25/06* (2013.01); *B65D 25/205* (2013.01)

(58) Field of Classification Search

CPC .. B65D 5/5038; B65D 5/32; B65D 1/00–225; B65D 25/005; B65D 25/06; B65D 25/16; B65D 25/205; B65D 25/30; B65D 25/54; B65D 2203/00–02

See application file for complete search history.

(56) References Cited

U.S. PATENT DOCUMENTS 3,967,666 A * 7/1976 Farrar ..... A61G 7/0503 383/7
4,436,243 A * 3/1984 Nason ..... B65D 5/38 229/122
4,625,908 A * 12/1986 Emery ..... B65D 5/5014 206/427
4,721,237 A * 1/1988 Leslie ..... F25D 3/08 150/901

(Continued)

OTHER PUBLICATIONS

Folden Lane; Folden Lane Collapsible Vegan Leather Baskets, https://www.westelm.com/products/collapsible-vegan-leather-baskets-d14189/?catalogId=71&sku=3625564&cm_ven=PLA&cm_cat=Google&cm_pla=Storage%20%3E%20Baskets%20%26%Bins&region_id=669950&cm_ite=3625564_14465514686&gclid=Cj0KCQjw4NujBhC5ARIsAF4Iv6djOp18D31bCt4CJtHkvuZPgbG-2w2koLrtpIMWkiX5oBLwxSpZRXUaAr89EALw_wcB; Website, Jul. 25, 2023.

(Continued)

*Primary Examiner* — Kareen K Thomas
(74) *Attorney, Agent, or Firm* — Heslin Rothenberg Farley & Mesiti P.C.

(57) ABSTRACT

A storage container includes a base with a front edge, a back edge, a first side edge, and a second side edge. The storage container further includes a front wall extending from the front edge of the base, the front wall defining an opening, a back wall extending from the back edge of the base, a first side wall extending from the first side edge of the base, and a second side wall extending from the second side edge of the base. The base, the front wall, the back wall, the first side wall and the second side wall bound a storage area, and top edges of the back wall, the front wall, the first side wall, and the second side wall form an opening.

18 Claims, 11 Drawing Sheets

(56) References Cited

U.S. PATENT DOCUMENTS

| | | | | |
|---|---|---|---|---|
| 4,779,752 | A * | 10/1988 | Vallee | B65D 25/06 296/39.2 |
| 4,934,589 | A * | 6/1990 | Stephenson | B65D 5/48 229/122 |
| 10,506,876 | B1 * | 12/2019 | Chen | F16B 21/09 |
| 12,330,847 | B1 * | 6/2025 | Wulf | B65D 55/16 |
| 2004/0232022 | A1 * | 11/2004 | Killinger | B42F 17/00 206/425 |
| 2006/0180488 | A1 * | 8/2006 | Spivey, Sr. | B65D 71/36 206/427 |
| 2011/0240636 | A1 | 10/2011 | Ma | |
| 2013/0043241 | A1 * | 2/2013 | Hunter | B65D 25/04 220/651 |
| 2016/0318653 | A1 * | 11/2016 | Pfeifer | B65D 5/5038 |
| 2017/0029169 | A1 * | 2/2017 | Shamp | B65D 21/0233 |
| 2017/0079426 | A1 * | 3/2017 | Davis | B65D 21/0212 |
| 2017/0233139 | A1 * | 8/2017 | Averill | B65D 85/76 220/533 |
| 2018/0112696 | A1 * | 4/2018 | Davis | A63H 33/105 |
| 2019/0107131 | A1 * | 4/2019 | Davis | B65D 9/34 |

OTHER PUBLICATIONS

US Amazon Logistics; Folding Storage Bins; https://haixinhome.com/products/folding-storage-bins-with-lids; Website; Jul. 25, 2023.

Yita Home; Storage Cabinet Foldable Storage Bins; hhttps://www.yitahome.com/shoe-box-storage-5002; Website; Jul. 25, 2023.

DIMJ; Large Closet Organizers and Fabric Storage Cube Bins; https://www.walmart.com/ip/DIMJ-Cube-Storage-Bins-Large-Closet-Organizers-Fabric-Folding-Cloth-Bins-Handle-Shelf-Trapezoid-Divider-Basket-Toy-DVD-Books-Files-Office-Nursery-Ash/1614915364; Website; Jul. 25, 2023.

DIMJ; Pack Collapsible Fabric Storage Baskets with Window, https://www.walmart.com/ip/DIMJ-Storage-Bins-Lids-4-Pack-Collapsible-Fabric-Baskets-Window-Closet-Organizer-Shelves-Clothes-Cubes-Handle-Toys-Book-Office-Ash-Grey/1619428815; Website; Jul. 25, 2023.

Joybos; Cotton Foldable Clothes Storage Box; https://joybos.com/products/joybos%C2%AE-cotton-foldable-clothes-storage-box-with-window?variant=41419553013944; Website; Jul. 25, 2023.

StorageWorks; StorageWorks Shoe Organizer for Closet, Fabric Shoe Storage Bins with Clear Cover, Adjustable Dividers for Shoe Storage, Beige, 1-Pack, Fits 16 Pairs; https://www.amazon.com/storageworks-organizer-storage-adjustable-dividers/dp/B0BTCTTKVB/ref=sr%201%2010?keywords=undefined&th=1; Website; Jul. 25, 2023.

StorageWorks; Storage Bags, Storage Containers for Clothes, Blanket Storage Bags with Dual Zipper, Clean Window Storage Bins; https://www.amazon.com/storageworks-storage-containers-clothes-blanket/dp/B0BN11RC9V?ref-ast%2Bsto%2Bdp=undefined&th=1; Website; Jul. 25, 2023.

Household Essentials; Adult Expandable Fabric Storage Bin; https://www.walmart.com/ip/Household-Essentials-Adult-Expandable-Fabric-Storage-Bin-Gray/377232868?wmlspartner=wlpa&selectedSellerId=0; Website; Jul. 25, 2023.

Sevendome; Linen Fabric Foldable Collapsible Storage Cube Bin Organizer Basket with Lid; https://www.amazon.com/SEVENDOME-Foldable-Collapsible-Organizer-Removable/dp/B09BQFTKN1?source=ps-sl-shoppingads-Ipcontext&ref_=fplfs&smid=A2PAWBDAWE90QR&th=1; Website; Jul. 25, 2023.

I Bkgoo; Stackable storage bins; https://www.amazon.com/Stackable-Foldable-Organizer-Own-Handle-Nursery%EF%BC%8CLiving/dp/B08BWY4BNW?source=ps-sl-shoppingads-Ipcontext&ref_=fplfs&psc=1&smid=A3AG93V6IW94II; Website; Jul. 25, 2023.

Naioewe; Cube Storage Organizer Clothing Portable Box Storage Storage Sundries Foldable Storage with Lid Foldable Box Box Housekeeping & Organizers; https://www.walmart.com/ip/Cube-Storage-Organizer-Clothing-Portable-Box-Storage-Storage-Sundries-Foldable-Storage-With-Lid-Foldable-Box-Box-Housekeeping-Organizers/3768701949; Website; Jul. 25, 2023.

Zammayang Trading; Foldable Cabinet Closet Organizers; https://www.walmart.com/ip/3-Pack-Bedroom-Storage-Box-Foldable-Cabinet-Closet-Organizers-Storage-Boxes-for-Storing-Socks-Underwear-Ties-Gray/3676371696?adsRedirect=true; Website; Jul. 25, 2023.

Suoco; Cube Storage Bins with Clear Window; https://www.amazon.com/SUOCO-13x13x13-Foldable-Container-Organizers/dp/B0919ZWZ5V?th=1; Website; Jul. 25, 2023.

* cited by examiner

MULTI-COMPARTMENT COLLAPSIBLE STORAGE CONTAINER

CROSS REFERENCE TO RELATED APPLICATIONS

This application is a continuation application which claims priority benefit under 35 U.S.C. § 120 of U.S. non-provisional application Ser. No. 18/364,053, filed Aug. 2, 2023, entitled MULTI-COMPARTMENT COLLAPSIBLE STORAGE CONTAINER, which is incorporated herein by reference in its entirety.

FIELD

The present disclosure relates generally to storage containers. More specifically, but not exclusively, the present disclosure relates to collapsible storage containers which can fold into a substantially flat shape for easy storage and transportation, and to storage containers having storage areas with multiple configurations for storing multiple types of items and in varying amounts.

BACKGROUND

A conventional storage container generally has a fixed structure made of wood, plastic, or a similar rigid material, and at least one compartment for storing goods, belongings, items, objects, materials, and the like. Due to its fixed structure, a conventional storage container may take up an unwanted or undesirable amount of space when not in use, and therefore may be difficult to store or transport. While it may be possible to disassemble a conventional storage container, such containers are generally not designed to be broken down and reassembled, and therefore disassembly and reassembly may be troublesome and/or laborious. Thus, there is a need for a variety of storage containers which are designed to be broken down and/or reduced in volume when the storage containers themselves need to be stored and/or transported.

Storage containers generally have a fixed number of compartments for storage, which may limit or cap the amount and/or the variety (e.g., types or kinds) of items which may be organized into the same storage container. In order to store a wider variety of items, a user may be required to mix items for storage that they would otherwise desire to keep separate, or to purchase additional storage containers with additional compartments. Thus, there is a need for storage containers which permit alterations to the number and/or size of the provided storage compartments.

Where a storage container has more than one compartment, the various compartments are generally accessible from the same direction or opening. Due to the design of such openings, a user may not have the ability to store sensitive or private items in the same containers as each other or as non-sensitive or non-private items, even if the user utilizes different storage compartments. Thus, there is a need for storage containers which permit a user to optionally conceal sensitive and/or private items. Further, there is a need for storage containers which have multiple openings or points of access, each of which corresponding to a different compartment for storage.

Thus, it is an object of the present disclosure to overcome one or more of the above-described drawbacks and/or disadvantage of the currently available systems and apparatus for storage containers.

SUMMARY

The present disclosure is directed toward systems and apparatus for collapsible and multi-compartment storage containers.

The present disclosure provides, in a first aspect, a storage container including a front edge, a back edge, a first side edge and a second side edge. The storage container further includes a front wall extending from the front edge of the base, the front wall defining a first opening, a back wall extending from the back edge of the base, a first side wall extending from the first side edge of the base, and a second side wall extending from the second side edge of the base. The base, the front wall, the back wall, the first side wall and the second side wall bound a storage area, top edges of the back wall, the front wall, the first side wall and the second side wall form a second opening.

The present disclosure provides, in a second aspect, a storage container including a lower base connected to a front wall having a first opening, a back wall opposite the front wall, a first side wall extending on a first side of the lower base between the front wall and the back wall, and a second side wall extending on a second side of the lower base between the front wall and the back wall, wherein the lower base, the front wall, the back wall, the first side wall and the second side wall bound a storage area. The storage container further includes an upper base including a second opening in an outer face of the front wall, the back wall, the first side wall or the second side wall.

The present disclosure provides, in a third aspect, a collapsible storage container system including a base and a plurality of walls extending from the base, the plurality of walls being connected to the base and bounding a storage area. The storage container system further includes at least one divider configured to separate the storage area into a first storage space and a second storage space. The plurality of walls includes a front wall defining a first opening to the first storage space, and top edges of the plurality of walls define a second opening to the storage space. The base and at least some walls of the plurality of walls are configured to fold inwardly towards a center of the storage container to transition the storage container between and open configuration and a folded configuration.

These and other objects, features, and advantages of this disclosure will become apparent from the following detailed description of the various aspects of the disclosure taken in conjunction with the accompanying drawings.

BRIEF DESCRIPTION OF THE FIGURES

The accompanying drawings, which are incorporated in and constitute a part of the specification, illustrate embodiments of the disclosure and together with the detailed description herein, serve to explain the principles of the disclosure. It is emphasized that, in accordance with the standard practice in the industry, various features are not drawn to scale. In fact, the dimensions of the various features may be arbitrarily increased or reduced for clarity of discussion. The drawings are only for purposes of illustrating preferred embodiments and are not to be construed as limiting the disclosure.

DETAILED DESCRIPTION

Figure 1:
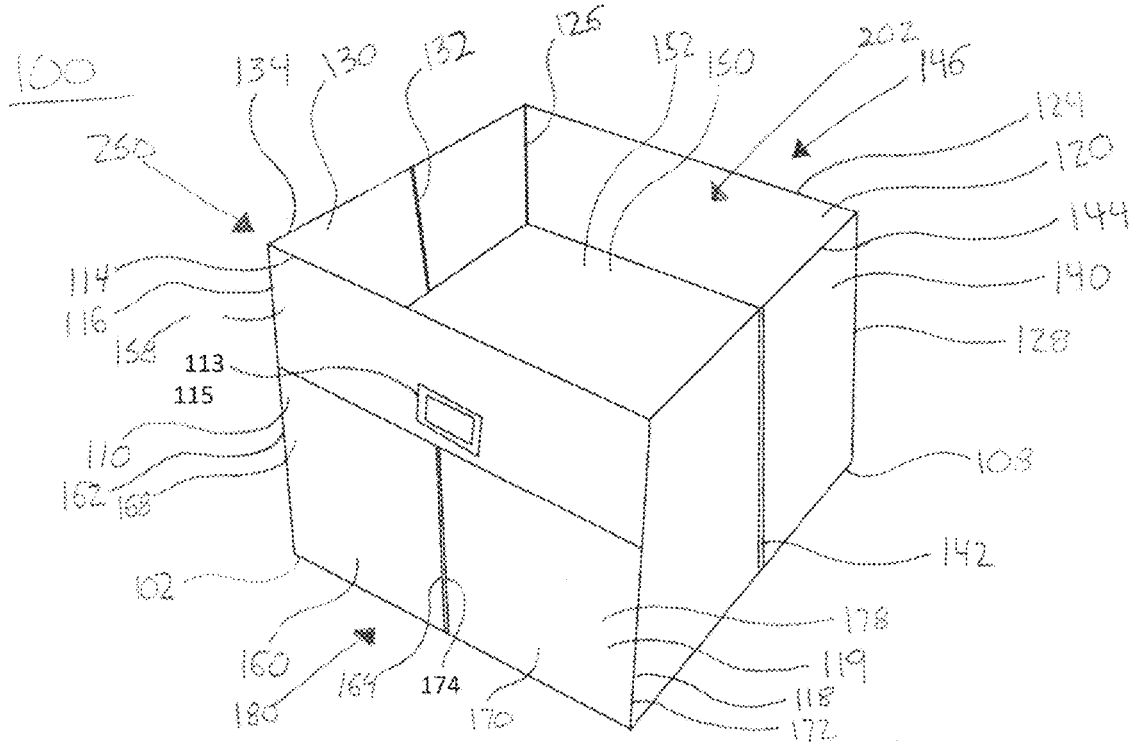
FIG. 1 depicts a first perspective view of a storage container constructed in accordance with one or more aspects of the present disclosure in an unfolded configuration, showing flaps in a closed position.

Generally stated, disclosed herein are various embodiments for a multi-compartment collapsible storage container. Aspects will be discussed hereinafter in detail in terms of various exemplary embodiments according to the present disclosure with reference to the accompanying drawings. In following the detailed description, numerous specific details are set forth in order to provide a thorough understanding of the present disclosure. It will be obvious, however, to those skilled in the art that the present invention may be practiced without these specific details. In other instances, well-known structures are not shown in detail in order to avoid unnecessary obscuring of the present invention.

Furthermore, there is no intention to be bound by any expressed or implied theory presented in the preceding field, background, summary, or the following detailed description. It is also understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In accordance with one or more aspects of the present disclosure, a multi-compartment collapsible storage container is provided. Referring to the drawings, wherein like reference numerals are used to indicate like or analogous components throughout the several views, and with particular reference to FIGS. 1-17, example embodiments of a multi-compartment collapsible storage container are discussed below.

Figure 2:
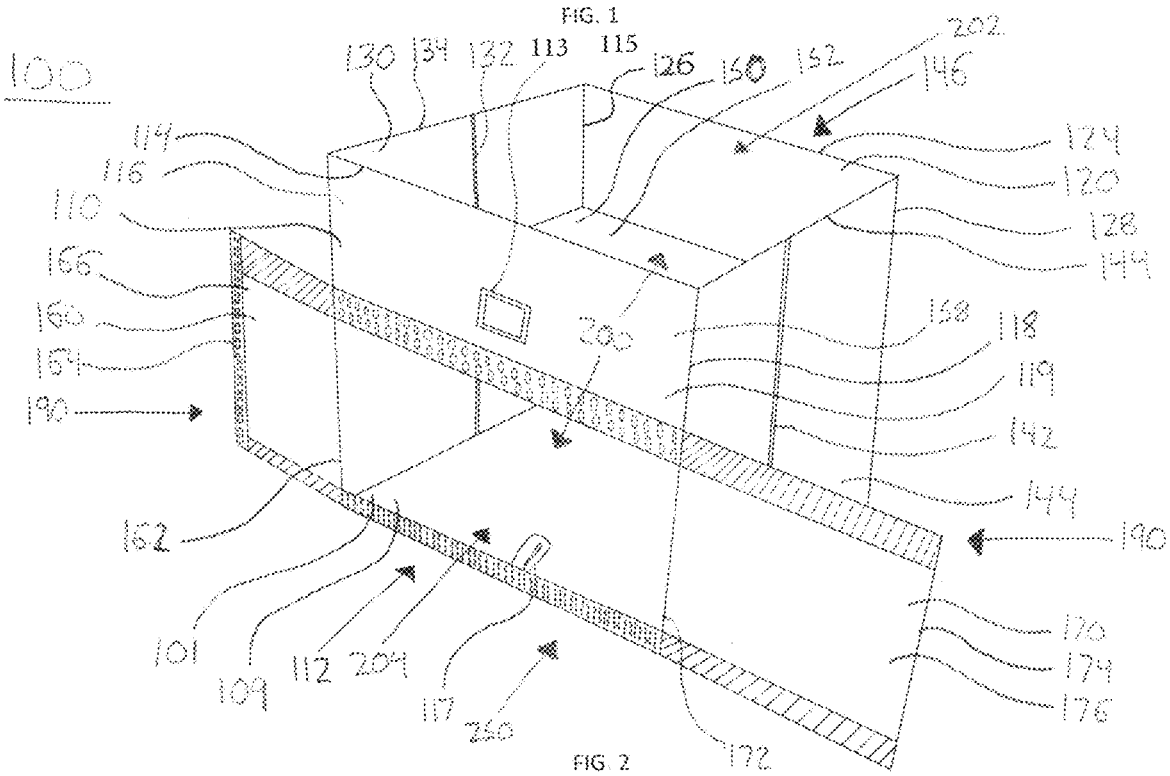
FIG. 2 depicts a another perspective view of the storage container of FIG. 1 showing the flaps in an open position.
Figure 7:
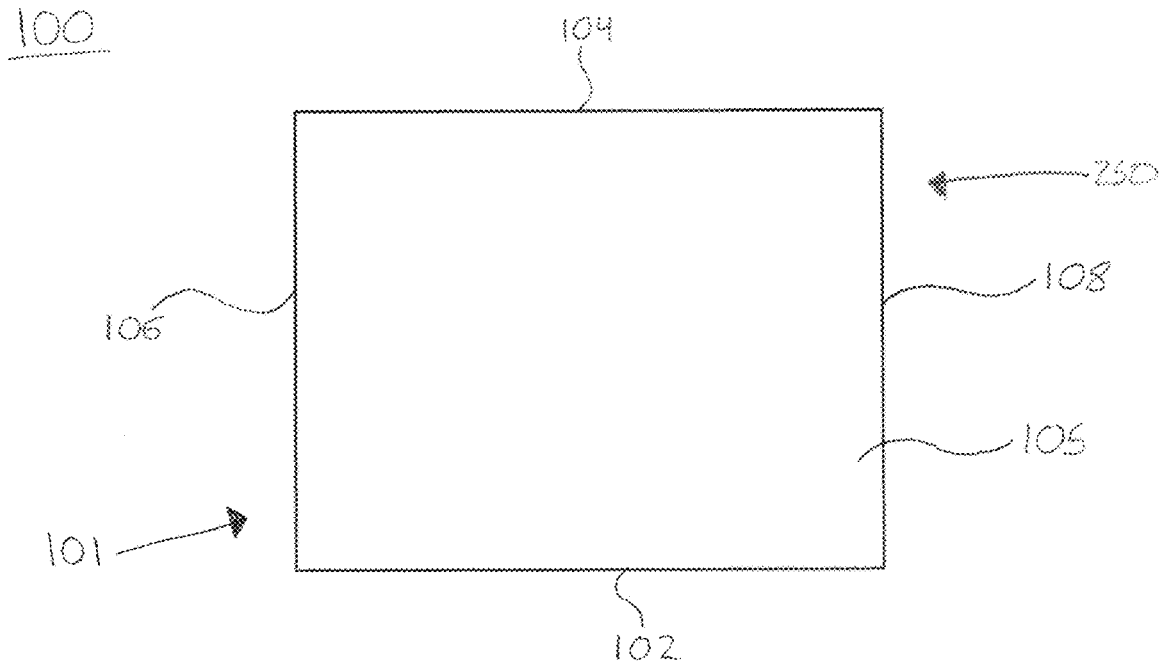
FIG. 7 depicts a bottom view of the storage container of FIG. 1.
Figure 8:
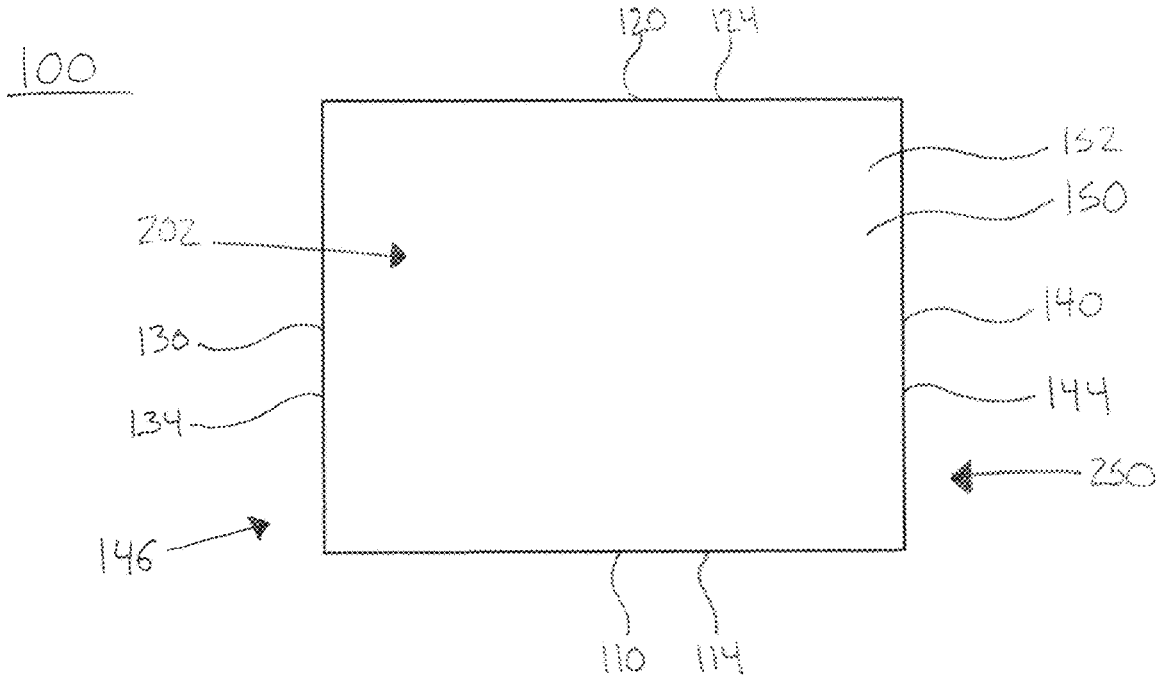
FIG. 8 depicts a top view of the storage container of FIG. 1.

As shown in FIGS. 1-2 and 7, a multi-compartment collapsible storage container 100 (referred to hereinafter as "storage container 100") may include a base 101 having a front edge 102, a back edge 104, a first side edge 106, and a second side edge 108. The front edge 102 may be opposite the back edge 104, and the first side edge 106 may be opposite the second side edge 108. The base 101 may be substantially rigid and/or substantially flat to provide a foundation for the storage container 100 to sit or lay on a flat surface, for example, a shelf, floor, table, etc. In some embodiments, the base 101 may include a combination of both rigid (or substantially rigid) and flexible, bendable, and/or foldable materials, as described in more detail below. The base may therefore have a square and/or rectangular shape.

The base 101 may be coupled with and/or connected to a front wall 110, a back wall 120, a first side wall 130, and a second side wall 140. The front edge 102 may be coupled with and/or connected to the front wall 110, the back edge 104 may be coupled with and/or connected to the back wall 120, the first side edge 106 may be coupled with and/or connected to the first side wall 130, and the second side edge 108 may be coupled with and/or connected to the second side wall 140. The front wall 110 may be opposite the back wall 120, and the first side wall 130 may be opposite the second side wall 140. The front wall 110, the back wall 120, the first side wall 130, and/or the second side wall 140 may each have a square and/or rectangular shape.

Looking to FIGS. 1-3 and 8, the front wall 110 may include a front opening 112, a top edge 114, a first side edge 116, and a second side edge 118. The back wall 120 may include a top edge 124, a first side edge 126, and a second side edge 128. The first side wall 130 may include a top edge 134 and may extend between the first side edge 116 of the front wall 110 and the first side edge 126 of the back wall 120, for example, along the first side edge 106 of the base 101. The second side wall 140 may include a top edge 144 and may extend between the second side edge 118 of the front wall 110 and the second side edge 128 of the back wall 120, for example, along the second side edge 108 of the base 101. The front wall 110, the back wall 120, the first side wall 130, and the second side wall 140 may form a continuous connection around the edges 102, 104, 106, 108 of the base 101. The storage container may therefore have a substantially cubic shape, or a shape which is substantially like that of a rectangular prism.

The top edge 114 of the front wall 110, the top edge 124 of the back wall 120, the top edge 134 of the first side wall 130, and the top edge of the second side wall 140 may bound an upper opening 146 to a storage area 200. The storage area 200 may extend between the upper opening 146 and the base 101, between the front wall 110 and the back wall 120, and/or between the first side wall 130 and the second side wall 140. The front wall may include a frame or slot 113 in which a user may removably insert a label, such as a piece of paper with writing, visibly into the front wall 110 to keep track of and/or communicate the contents of the storage container 100. When not occupied by a label, the slot 113 may further function as a grasping point for the user to control the storage container 100, for example, by pulling on the slot 113 to move and/or slide the storage container 100 out of a cubby, storage grid, or other storage system.

The slot 113 may further include a window 115 providing visibility into the storage area 200. For example, when the storage container 100 is located in a cubby or the like, a user may not have immediate access to the upper opening 146 to view the storage area 200 and/or any of the contents thereof (e.g., another structure may block visibility of the storage area 200 through the upper opening 146). In such a scenario, the user may peer through the window 115 to view the storage area 200 rather than removing the storage container from the cubby to view the contents through the upper opening 146. The window 115 may be a through-hole extending through the front wall 110, or the window 115 may be a clear material (e.g., plastic) which may be integral with the front wall 110. Where the window 115 is a through-hole, the user may grasp and/or hook the storage container 100 (e.g., with a finger) through the window 115 from an exterior of the storage container 100 to assist in moving and/or sliding the storage container 100 when pulling on the slot 113.

In one embodiment, the storage container 100 may further include a first divider 150 located between the upper opening 146 and the base 101 and may be substantially parallel to the base 101. At least a portion of the first divider 150 may be monolithically formed with the front wall 110, the back wall 120, the first side wall 130, and/or the second side wall 140. The first divider 150 may extend between the front wall 110 and the back wall 120, and between the first side wall 130 and the second side wall 140, such that the storage area 200 is partitioned, split, divided, and/or separated into an upper storage space 202 and a lower storage space 204. Fluid communication between the upper storage space 202 and the lower storage space 204 may be prohibited and/or prevented by the first divider 150.

Figure 3:
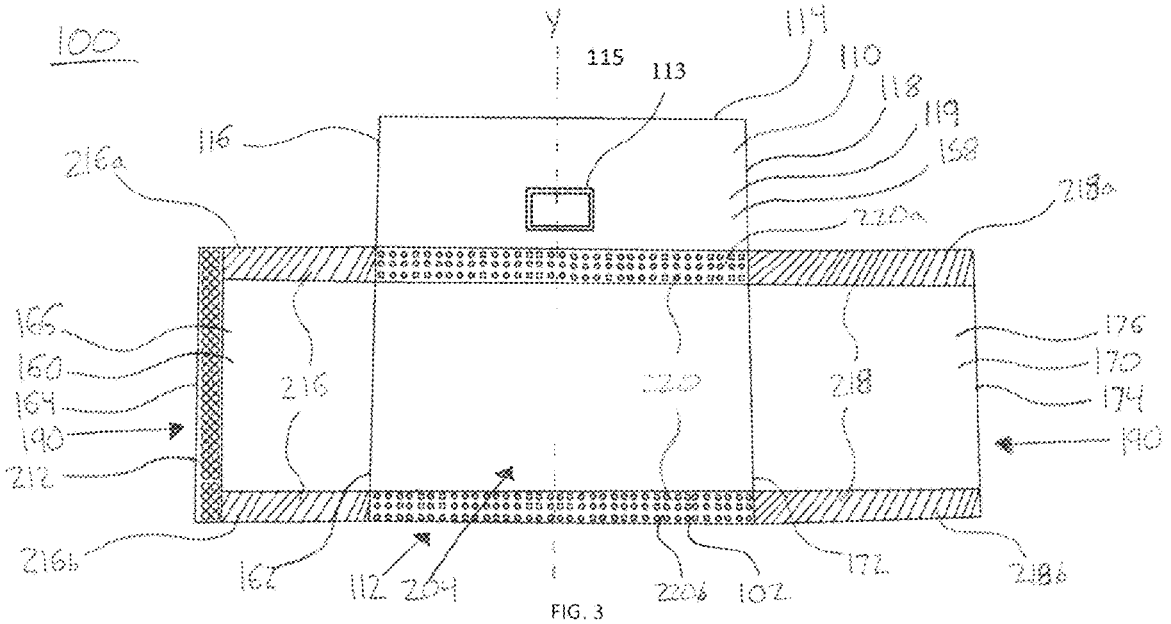
FIG. 3 depicts a front view of the storage container of FIG. 2.

The upper storage space 202 may extend between the first divider 150 and the upper opening 146, and the lower storage space 204 may extend between the first divider 150 and the base 101. The upper storage space 202 may be in fluid communication with and/or accessible through the upper opening 146, and the lower storage space 204 may be in fluid communication with and/or accessible through the front opening 112. The front opening 112 may thus extend between the first divider 150 and the base 101 to provide access to the lower storage space 204. For example, the front opening 112 may extend between the first divider 150 and the base 101, as shown in FIGS. 2-3. The base 101 may provide a floor or foundation for storing items within the lower storage space 204, and the first divider 150 may provide a floor or foundation for storing items within the upper storage space 202.

The front wall 110 may further include a first door or flap 160 and/or a second door or flap 170 configured (e.g., shaped and/or dimensioned) to detachably and/or removably engage, couple, connect, and/or attach with each other and/or with a remainder 158 of the front wall 110 to cover the front opening 112 or a portion thereof, as shown in FIGS. 1-3 and 17. The first flap 160 may include a first pivoting end 162 and a first free end 164, and the second flap 170 may include a second pivoting end 172 and a second free end 174. In the example shown, where the front opening 112 extends between the first side edge 116 of the front wall 110 and the second side edge 118 of the front wall 110, the first pivoting end 162 may be connected along the first side edge 116, and the second pivoting end 172 may be connected along the second side edge 118. However, in other embodiments, the first pivoting end 162 and the second pivoting end 172 may couple with and/or connect to anywhere along the front wall 110 which permits the first flap 160 and/or the second flap 170 to pivot between a closed position 180 and an open position 190 to cover and/or uncover the first opening 112. The first flap 160 and the second flap 170 may move independently from each other.

In FIG. 1, the first flap 160 and the second flap 170 are shown in the closed position 180, wherein fluid communication between the lower storage space 204 and an exterior of the storage container 100 may be prevented or cut-off. In the closed position 180, the first free end 164 and the second free end 174 may be coupled with and/or connected to each other and/or to the remainder 158 of the front wall 110. Further, in the closed position 180, the contents of the lower storage space 202 may not be visible from the exterior of the storage container 100. The lower storage space 202 may therefore conceal some or all of its contents in the closed position 180, providing optional privacy to the user of the storage container 100.

Figure 4:
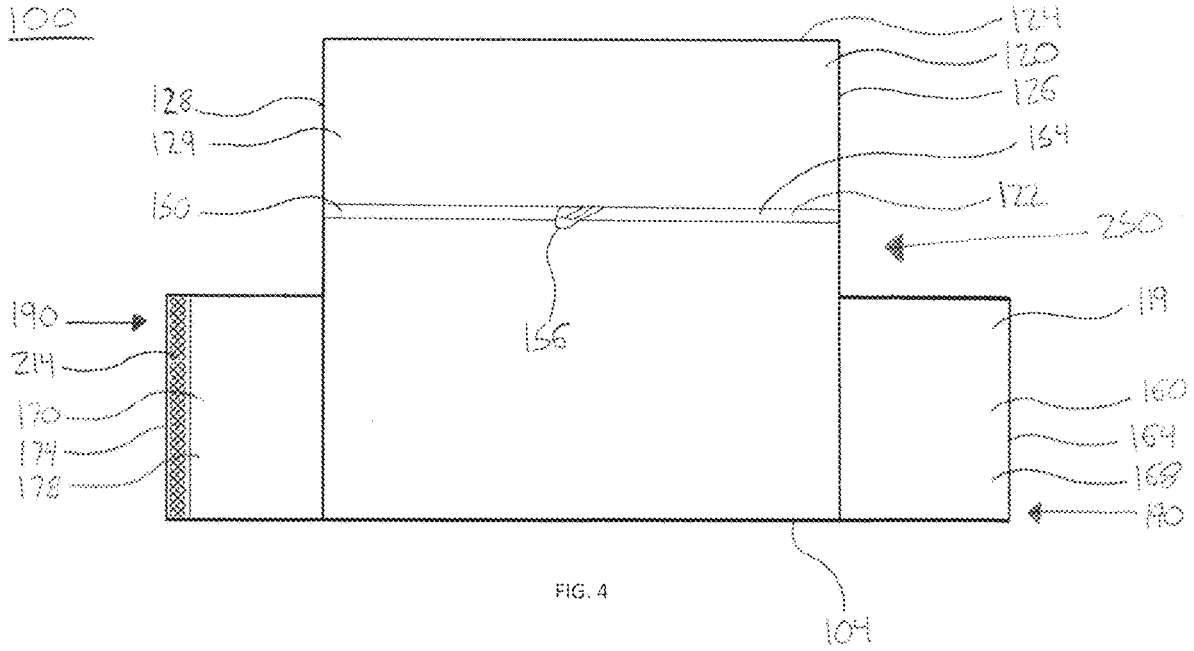
FIG. 4 depicts a back view of the storage container of FIG. 2.

To transition from the closed position 180 shown in FIG. 1 to the open position 190 shown in FIGS. 2-4, the first flap 160 and/or the second flap 170 may be detached from each other and/or the remainder 158 of the front wall 110. The first flap 160 may then be pivoted about the first pivoting end 162 away from the second flap 170 and/or the front opening 112, and the second flap 170 may be pivoted about the second pivoting end 172 away from the first flap 160 and/or the front opening 112.

To transition from the open position 190 to the closed position 180, the first flap 160 may be pivoted about the first pivoting end 162 towards the second flap 170 and/or the front opening 112, and the second flap 170 may be pivoted about the second pivoting end 172 towards the first flap 160 and/or the front opening 112, until the first flap 160 and/or the second flap 170 cover the front opening 112 or a portion thereof. Said another way, the first flap 160 and the second flap 170 may be pivoted towards each other until the first flap 160 and the second flap 160 engage with, couple, connect, and/or attach with each other and/or the remainder 158 of the front wall 110, or until the first flap 160 and the second flap 170 are substantially flat with and/or aligned parallel to the remainder 158 of the front wall 110, such that the front opening 112 is closed and/or covered, or partially closed and/or covered.

Turning back to FIGS. 1-3 and 17, the first flap 160 and the second flap 170 may have equal lengths and may engage with, connect, couple, and/or attach with each other and/or with the remainder 158 of the front wall 110 along an axis Y extending vertically from a center of the front edge 102 of the base 101 through a center of the top edge 114 of the front wall. However, in other embodiments, the first flap 160 and the second flap 170 may be of different lengths and may therefore engage, connect, couple, and/or attach with each other and/or the remainder 158 of the front wall 110 at various other locations along the front wall 110. In further embodiments, there may be only a first flap 160 and no second flap 170, in which case the first flap 160 which may have a length, for example, which is equal to a distance between the first side edge 116 of the front wall 110 and the second side edge 118 of the front wall 110. The first flap 160 may alternatively have any other length which permits the first flap 160 to pivot about the pivoting end 162 to transition between the closed position 180 and the open position 190 (i.e., to cover and/or uncover the front opening 112) as described above. For example, the first flap 160 may have any dimensions which match and/or correspond to dimensions of the front opening 112 to permit the first flap 160 to close and/or cover the front opening 112 or a portion thereof.

Turning to FIGS. 2-4, the first flap 160 and the second flap 170 are depicted in the open position 190. In the open position 190, the lower storage space 204 may be exposed (i.e., the lower storage space 202 may be accessible from the exterior of the storage container 100) through the front opening 112. In the open position 190, the first free end 164 and/or the second free end 174 may not be engaged, connected, coupled, and/or attached with another structure (i.e., the first free end 164 and the second free end 174 may not be constrained or fixed to each other or to the remainder 158 of the front wall 110). Alternatively, the first free end 164 and/or the second free end 174 may engage, connect, couple, and/or attach with the first side wall 130 and the second side wall 140, respectively to maintain the open position 190, for example, via touch fasteners as described below.

A plurality of touch fasteners may be provided on the first flap 160, the second flap 170, and/or the remainder 158 of the front wall 110 to facilitate the various connections between the first flap 160, the second flap 170, and/or the remainder 158 of the front wall 110 as described above. For example, a corresponding first vertical touch fastener 212 and second vertical touch fastener 214 of the plurality of touch fasteners (e.g., hooks and loops, mushrooms and mushrooms, etc.) may be provided and/or located on the first free end 164 of the first flap 160 and the second free end 174 of the second flap 170, respectively, to facilitate the connection between the first flap 160 and the second flap 170 to cover and/or close the front opening 112 or a portion thereof. In the example shown in FIGS. 2-4, the first vertical touch fastener 212 may be located on an inner face or surface 166 of the first flap 160 (i.e., the surface which faces the lower storage space 204 when the storage container 100 is in the closed position 180), and the second vertical touch fastener 214 may be located on an outer face or surface 178 of the second flap 170 (i.e., the surface which faces away from the lower storage space 204 when the storage container is in the closed position 180). When the first flap 160 and/or the second flap 170 are pivoted about the first pivoting end 162 and the second pivoting end 172 to transition between the open position 190 and the closed position 180, the first touch fastener 212 and the second touch fastener 214 may removably and/or detachably engage, couple, connect, and/or attach with each other and/or with the remainder of the front wall 110 to cover and/or close the front opening 112. In the example embodiment, due to the placement of the first vertical touch fastener 212 and the second vertical touch fastener 214, it may be preferable to pivot the second flap 170 to the closed position 180 before pivoting the first flap 160 to the closed position 180 to properly expose the second touch fastener 214 for engagement, coupling, connecting, and/or attaching with the first touch fastener 212.

The second vertical touch fastener 214 may serve an additional purpose and/or function to fix the second flap 170 in place when the storage container is in the open position 190. In the embodiment shown in FIG. 4, the second flap 170 may be pivoted away from the second flap 160 and/or the front opening 112 until the second vertical touch fastener 212 contacts the second side wall 140, such that the second vertical touch fastener 212 engages, couples, connects, and/or attaches with the second side wall 140. The engagement, coupling, connection, and/or attachment of the second vertical touch fastener 212 with the second side wall 140 may fix the second flap 170 in place along the second side wall 140. A user may choose to fix the second flap 170 to the second side wall 140 to maintain the open position 190 of the second flap 170. A similar touch fastener to the second vertical touch fastener 212 may be present on the first flap 160 in addition to the second flap 170 to permit both the first flap 160 and the second flap 170 to be simultaneously fixed in the open position 190.

It should be readily understood by one skilled in the art that wherever the plurality of touch fasteners may appear on the first flap 160 and/or the second flap 170 as described herein, the reverse may also be employed to achieve the present disclosure. For example, in an embodiment not shown, the first touch fastener 212 may be located on an outer face or surface 168 of the first flap 160 (i.e., the surface which faces away from the lower storage space 204 when the storage container is in the closed position 180), and the second touch fastener 214 may be located on an inner face or surface 176 of the second flap 170 (i.e., the surface which faces the lower storage space 204 when the storage container 100 is in the closed position 180). In such an embodiment, it may be necessary to pivot the first flap 160 to the closed position 180 before pivoting the second flap 170 to the closed position 180 to properly expose the first touch fastener 212 for engagement, coupling, connecting, and/or attaching with the second touch fastener 212.

The plurality of touch fasteners may also include a first horizontal touch fastener 216 located and/or provided on the first inner surface 166 of the first flap 160, a second horizontal touch fastener 218 located and/or provided on the second inner surface 176 of the second flap 170, and/or a third horizontal touch fastener 220 located and/or provided on the remainder 158 of the front wall 110, as shown in FIGS. 2-3. The first horizontal touch fastener 216 may run or extend horizontally along the first inner surface 166, for example, between the first pivoting end 162 and the first free end 164. The second horizontal touch fastener 218 may run or extend horizontally along the second inner surface 176, for example, between the second pivoting end 172 and the second free end 174. The third horizontal touch fastener 220 may run or extend horizontally along an outer surface 119 of the front wall 110 along the remainder 158 of the front wall 110 (i.e., the surface which faces away from the lower storage space 204), for example, between the first side edge 116 of the front wall 110 and the second side edge 118 of the front wall 110. The third horizontal touch fastener 220 may be configured (e.g., shaped and/or dimensioned) to align with the first horizontal touch fastener 216 and/or the second horizontal touch fastener 218 when the storage container 100 is in the closed position 180. In an example, the third horizontal touch fastener 220 may contact the front opening 112, for example, above and/or below the front opening 112 on the remainder 158 of the front wall 110.

The third horizontal touch fastener 220 may be configured (e.g., shaped and/or dimensioned) to detachably and/or removably couple, connect, attach and/or engage with at least a portion of the first horizontal touch fastener 216 and/or at least a portion of the second horizontal touch fastener 218 to cover and/or close the front opening 112. That is, to cover and/or close the front opening 112, the first flap 160 may be pivoted about the first pivoting end 162 toward the remainder 158 of the front wall 110 such that the first horizontal touch fastener 216 detachably and/or removably couples, connects, attaches and/or engages with the third horizontal touch fastener 220, and the second flap 170 may be pivoted about the second pivoting end 172 toward the remainder 158 of the front wall 110 such that the second horizontal touch fastener 216 detachably and/or removably couples, connects, attaches and/or engages with the third horizontal touch fastener 220.

The third horizontal touch fastener 220 may include a first fastening strip 220*a* and a second fastening strip 220*b* running and/or extending horizontally across the remainder 158 of the front wall 110, for example, on the outer surface 109 and above and/or below the front opening 112. In such an embodiment, the first horizontal touch fastener 216 may include a first fastening strip 216*a* and a second fastening strip 216*b*, and/or the second horizontal touch fastener 218 may include a first fastening strip 218*a* and a second fastening strip 218*b*. The first fastening strip 216*a* and the second fastening strip 216*b* of the first horizontal touch fastener 216 may correspond with and/or be configured (e.g., shaped and/or dimensioned) to detachably and/or removably couple, connect, attach and/or engage with at least a portion of the first fastening strip 220*a* and at least a portion of the second fastening strip 220*b* of the third horizontal touch fastener 220, respectively. For example, at least a portion of the first fastening strip 216*a* of the first horizontal touch fastener 216 may detachably and/or removably couple, connect, attach and/or engage with at least a portion of the first fastening strip 220*a* of the third horizontal touch fastener 220, and at least a portion of the second fastening strip 216*b* of the first horizontal touch fastener 216 may detachably and/or removably couple, connect, attach and/or engage with at least a portion of the second fastening strip 220*b* of the third horizontal touch fastener 220. Similarly, at least a portion of the first fastening strip 218*a* and at least a portion of the second fastening strip 218*b* of the second horizontal touch fastener 218 may correspond with and/or be configured (e.g., shaped and/or dimensioned) to detachably and/or removably couple, connect, attach and/or engage with at least a portion of the first fastening strip 220*a* and at least a portion of the second fastening strip 220*b* of the third horizontal touch fastener 220, respectively. For example, the first fastening strip 218*a* of the second horizontal touch fastener 218 may detachably and/or removably couple, connect, attach and/or engage with at least a portion of the first fastening strip 220*a* of the third horizontal touch fastener 220, and the second fastening strip 218*b* of the second horizontal touch fastener 218 may detachably and/or removably couple, connect, attach and/or engage with at least a portion of the second fastening strip 220*b* of the third horizontal touch fastener 220.

As described above, in some embodiments (not shown) there may only be a first flap 160 and no second flap 170. In such an embodiment, the first fastening strip 216*a* of the first horizontal touch fastener 216 may be configured, shaped and/or dimensioned to detachably and/or removably engage, couple and/or attach along the entirety of the first fastening strip 220*a* of the third horizontal touch fastener 220 (rather than merely a portion), and/or the second fastening strip 216*b* of the first horizontal touch fastener 216 may be configured, shaped and/or dimensioned to detachably and/or removably engage, couple and/or attach with the entirety of the second fastening strip 220*b* of the third horizontal touch fastener 220 to cover and/or close the front opening 112.

Various surfaces of (e.g., coverings and/or linings) the storage container 100 (e.g., the inner surfaces 166, 176 and the outer surfaces 168, 178 of flaps 160, 170, and/or the outer surface 119 of the front wall 110, etc.) may include a woven and/or fabric covering, for example, polyester, which may naturally be capable of detachably and/or removably engaging, connecting, coupling, and/or attaching with various types and/or kinds of touch fasteners described above, for example, hook and loop fasteners. Other materials which may be used to cover and/or line the storage container 100 include acrylic fabric, felt, polypropylene fibers (for example, unwoven, including polypropylene Spunbond-Meltblow-Spunbond (SMS), polypropylene spunbond, and other similar variations), cotton (e.g., variants such as canvas, duck, damask, ticking, muslin, etc.) nylon, poly blend (e.g., cotton-polyester blends, polyester-Spandex/elastane blends, polyester cotton rayon blends, etc.), chenille, vinyl mesh, polyvinyl chloride (PVC), linen and linen blend, corduroy, etc. These woven and/or fabric coverings and/or linings may cover and/or line a more rigid material used to support the structure of the storage container 100, for example, cardboard, plexiglass, matboard, fiber board (varying from low to high densities) including chipboards and/or particle boards, molded plywood, composite blend plastics such as resin (e.g., polyethylene, polyester, phenolic, alkyd, polypropylene, polyepoxides, etc.), cork, etc. Chipboards and/or particle boards may be made, for example, of mixed resin and woodchips. The material which supports the structure of the storage container 100 may be sufficiently rigid to permit the storage container 100 to keep its shape in the unfolded configuration 250, and/or which permits the storage container 100 to hold items in the unfolded configuration 250.

In some embodiments it may therefore be unnecessary to include corresponding pairs of touch fasteners because the touch fasteners may be capable of direct engagement with a woven and/or fabric material covering the surfaces of the storage container 100. For example, the inner surfaces 166, 176 and the outer surfaces 168, 178 of the first flap 160 and the second flap 170 may include polyester, in which case only the first vertical touch fastener 212 of the first flap 160 may be necessary to close and/or cover the front opening 112. For example, the first vertical touch fastener 212 may be located on the inner surface 166 along the first free end 164 of the first flap 160, such that the first flap 160 may be pivoted toward the remainder 158 of the front wall 110 to detachably and/or removably engage, couple and/or attach with the outer surface 178 of the second flap 170 along the second free end 174 to cover and/or close the front opening 112, or to detachably and/or removably engage, couple and/or attach with a portion of the remainder 158 of the front wall 110 to cover and/or close the front opening 112 or a portion thereof. It will be clear to one skilled in the art that various combinations, configurations, and/or placements of the first flap 160 and/or the second flap 170 (e.g., a single flap vs. two flaps) and/or the plurality of touch fasteners (e.g., vertical and/or horizontal fasteners, and/or different quantities thereof) may be employed to achieve the present disclosure.

Figure 9:
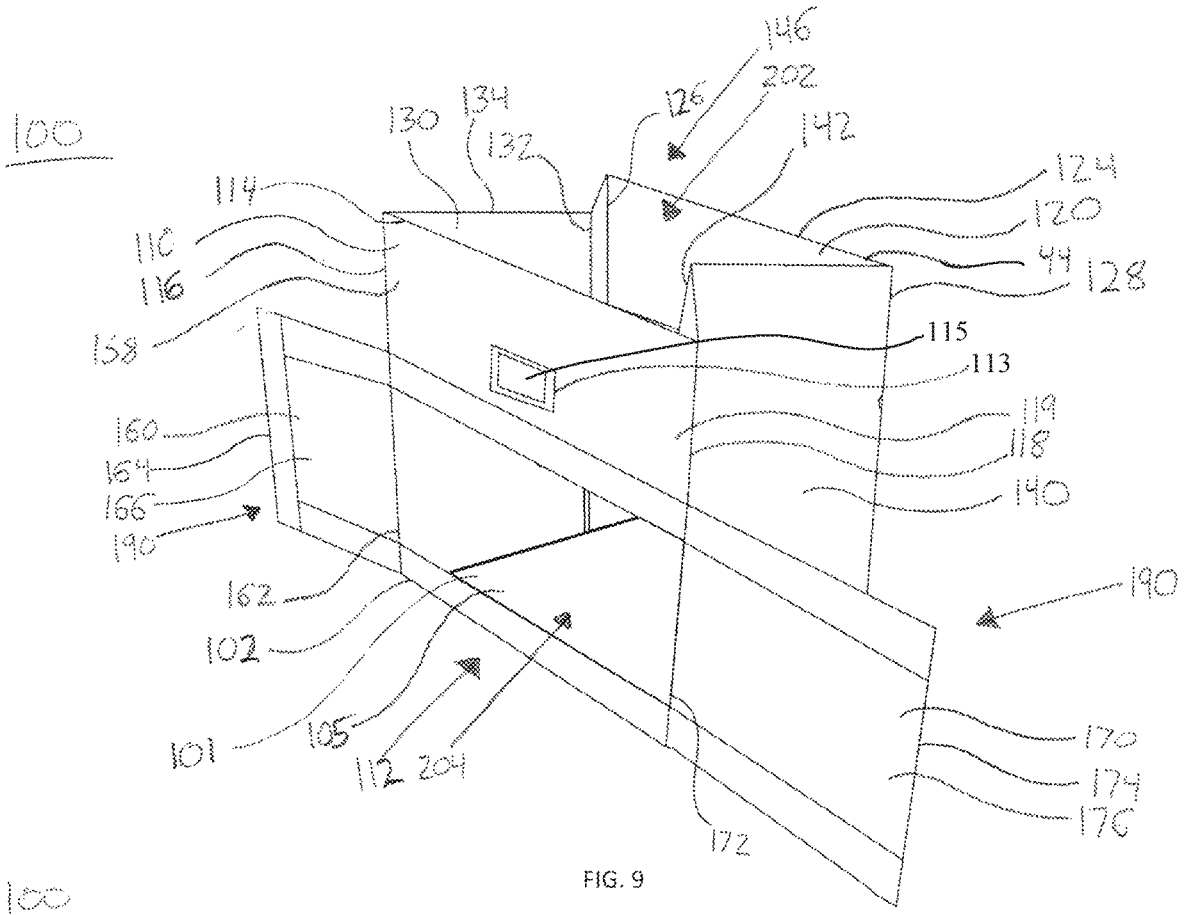
FIG. 9 depicts a perspective view of the storage container of FIG. 1 transitioning between the unfolded configuration and a folded configuration.
Figure 10:
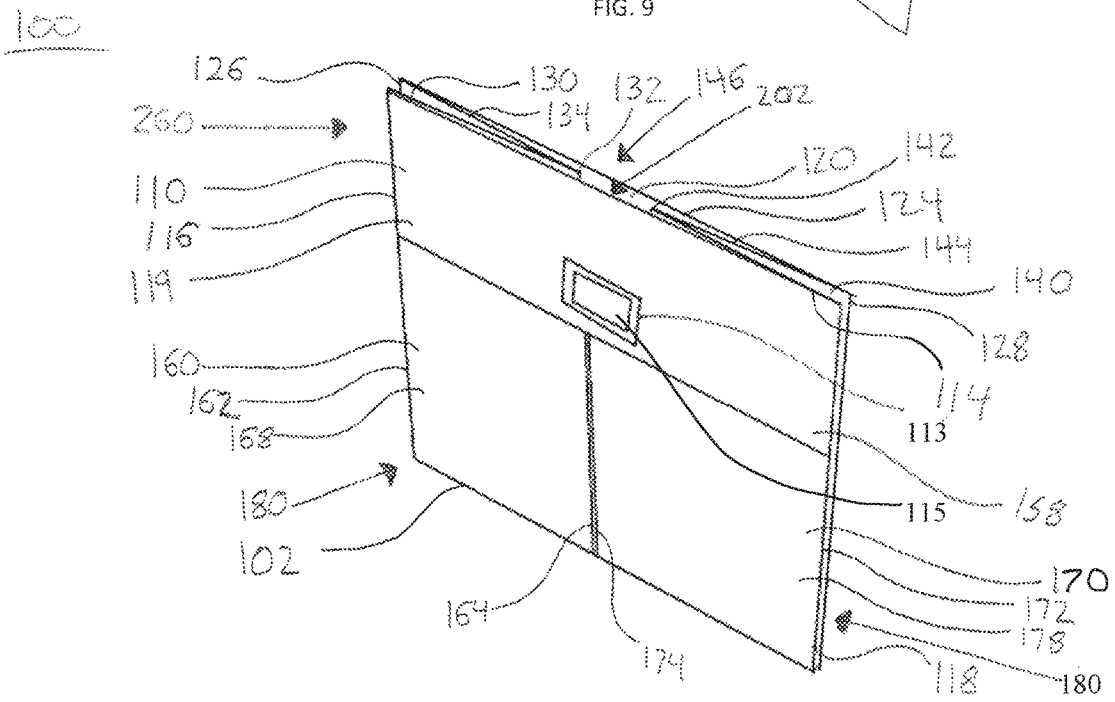
FIG. 10 depicts a perspective view of the storage container of FIG. 1 in the folded configuration.

Turning now to FIGS. 1-2 and 9-10 in combination, the storage container 100 may be foldable and/or collapsible. For example, the storage container may be capable of transitioning (as shown in FIG. 9) between an open, uncollapsed and/or unfolded configuration 250 (as shown in FIGS. 1-2) and a closed, collapsed and/or folded configuration 260 (as shown in FIG. 10). In the unfolded configuration 250, the upper storage space 202 and the lower storage space 204 may be configured and/or optimized to receive and/or hold items, objects, materials, etc. In the folded configuration 260, the upper storage space 202 and the lower storage space 204 may be substantially flattened, reducing the space (i.e., volume) the storage container 100 may occupy, for example, when the storage container 100 itself is stored and/or transported. Therefore, in the unfolded configuration 250, the storage area 200 may have a first volume, and in the folded configuration 260, the storage area 200 may have a second volume, wherein the first volume is larger than the second volume. The first side wall 130 and the second side wall 140 may be configured (e.g., shaped and/or dimensioned) to facilitate the folding and/or bending, and/or the unfolding and/or unbending of the storage container 100 between the unfolded configuration 250 and the folded configuration 260.

Figure 5:
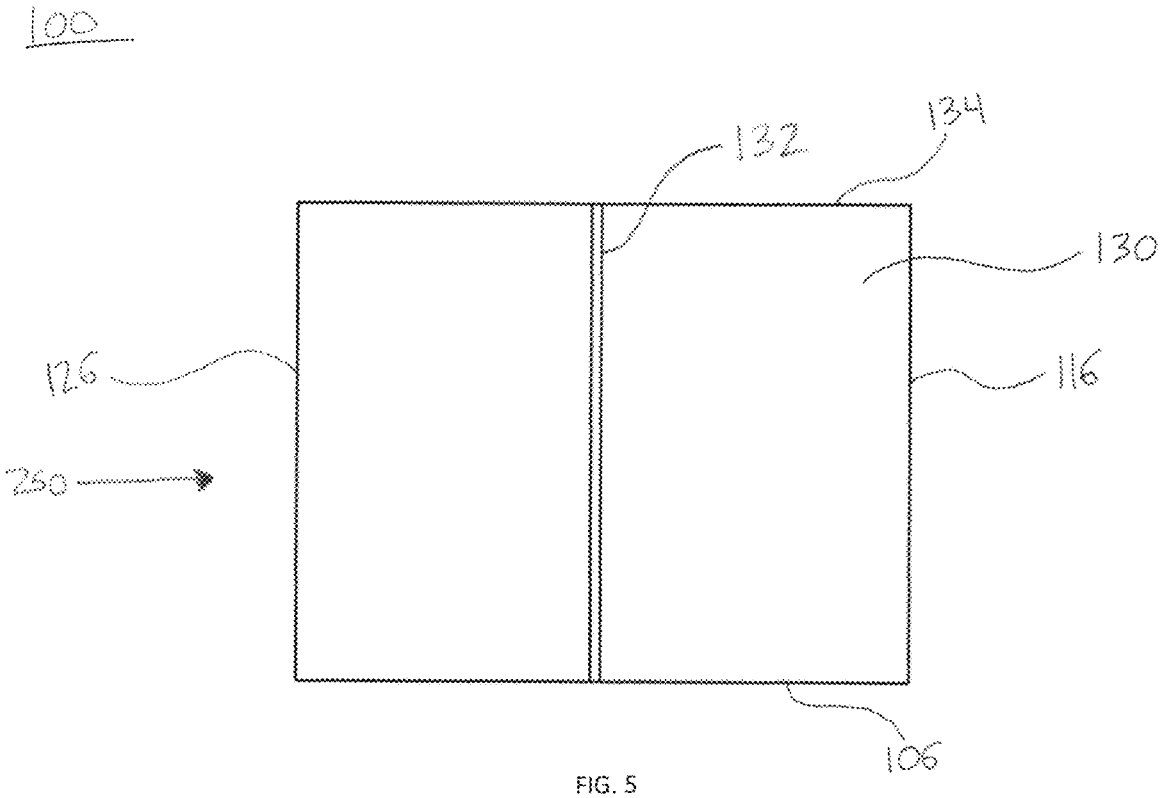
FIG. 5 depicts a first side view of the storage container of FIGS. 1-2.
Figure 6:
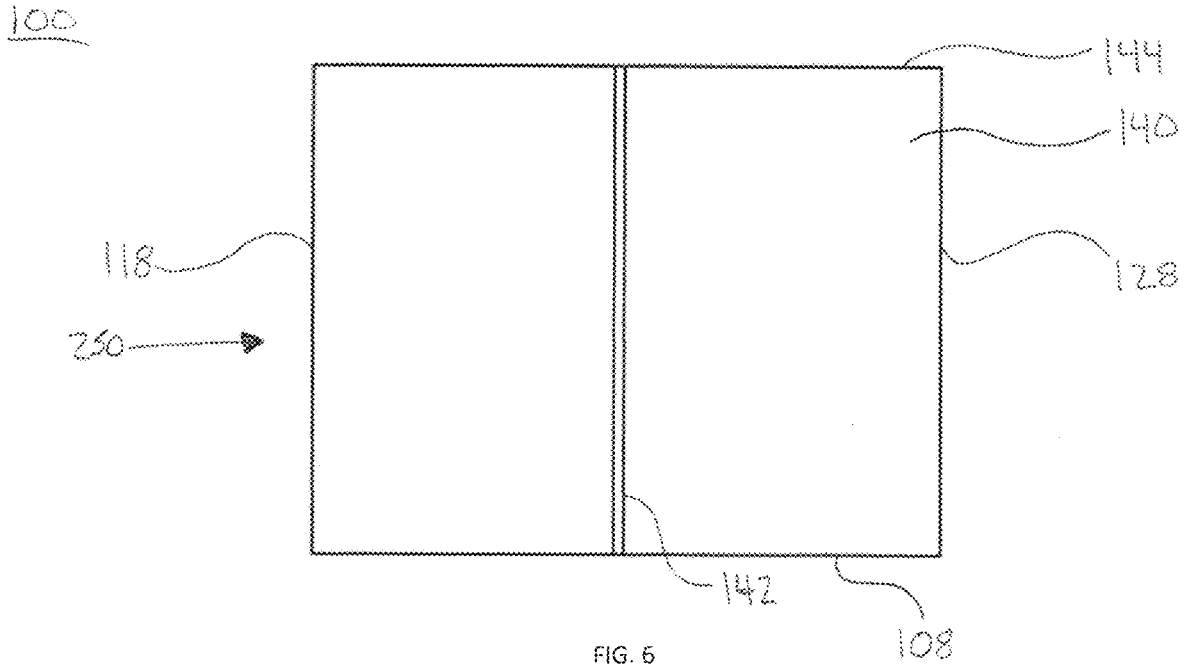
FIG. 6 depicts a second side view of the storage container of FIGS. 1-2.

Referencing FIGS. 5-6, the first side wall 130 may include a first crease 132 and the second side wall 140 may include a second crease 142 to facilitate and/or assist with the transition between the unfolded configuration 250 and the folded configuration 260. For example, the first crease 132 may extend between a center of the first side edge 106 of the base 101 and a center of the top edge 134 of the first side wall 130, and the second crease 142 may extend between a center of the second side edge 108 of the base 101 and a center of the top edge 144 of the second side wall 140.

Referring back to FIGS. 1-2 and 9-10, and beginning in the unfolded configuration 250, the first side wall 130 may be configured (e.g., shaped and/or dimensioned) to crunch, flex, bend, and/or fold inwardly along the first crease 132 towards the storage area 200, and the second side wall 140 may be configured (e.g., shaped and/or dimensioned) to crunch, flex, bend, and/or fold inwardly along the second crease 142 towards the storage area 200, such that a distance between the first crease 132 and the second crease 142 is reduced and/or eliminated, and/or a distance between the front wall 110 and the back wall 120 is reduced and/or eliminated. The inward crunching, flexing, bending and/or folding of the first side wall 130 may occur simultaneously with the inward crunching, flexing, bending, and/or folding of the second side wall 140. Alternatively, the inward crunching, flexing, bending and/or folding of the first side wall 130 may occur independently from the inward crunching, flexing, bending and/or folding of the second side wall 140. For example, the crunching, flexing, folding and/or bending may occur in steps, wherein the first side wall 130 is crunched, flexed, bent and/or folded inwardly and then the second side wall 140 is crunched, flexed, bent and/or folded inwardly.

On the other hand, beginning in the folded configuration 260, the first side wall 130 may be configured (e.g., shaped and/or dimensioned) to uncrunch, flex, bend and/or fold outwardly along the first crease 132 away from the storage area 200, and the second side wall 140 may be configured (e.g., shaped and/or dimensioned) to uncrunch, flex, bend and/or fold outwardly along the second crease 142 away from the storage area 200, such that a distance between the first crease 132 and the second crease 142 is increased, and/or a distance between the front wall 110 and the back wall 120 is increased. In an example, the first side wall 130 and the second side wall 140 may be configured (e.g., shaped and/or dimensioned) to uncrunch, flex, bend and/or fold outwardly away from each other until a distance between the first crease 132 and the second crease 142 is equal to a length of the front edge 102 and/or the back edge 104 of the base 101. The outward uncrunching, flexing, bending, and/or folding of the first side wall 130 may occur simultaneously with the outward uncrunching, flexing, bending, and/or folding of the second side wall 140. Alternatively, the outward uncrunching, flexing, bending, and/or folding of the first side wall 130 may occur independently from the outward uncrunching, flexing, bending, and/or folding of the second side wall 140. For example, the uncrunching, flexing, folding and/or bending may occur in steps, wherein the first side wall 130 is uncrunched, flexed, bent and/or folded outwardly and then the second side wall 140 is uncrunched, flexed, bent and/or folded outwardly.

As can be seen in FIGS. 1-2, the unfolded configuration 250 supports the first flap 160 and the second flap 170 in both the closed position 180 and the open position 190. Further, as can be seen in FIGS. 9-10, the folded configuration 260 similarly supports the first flap 160 and the second flap 170 in both the closed position 180 and the open position 190. Therefore, the first flap 160 and the second flap 170 may be unaffected by the transition between the unfolded configuration 250 and the folded configuration 260. That is, the first flap 160 and the second flap 170 may be pivotable about the first pivoting end 162 and the second pivoting end 172, respectively, to cover the front opening 112, regardless of whether the storage container 100 is in the unfolded configuration 250, the folded configuration 260, or any transitory configurations which may exist therebetween. However, the closed position 180 may be desirable than the open position 190 for purposes of storage and/or transport of the storage container 100 itself.

Figure 13:
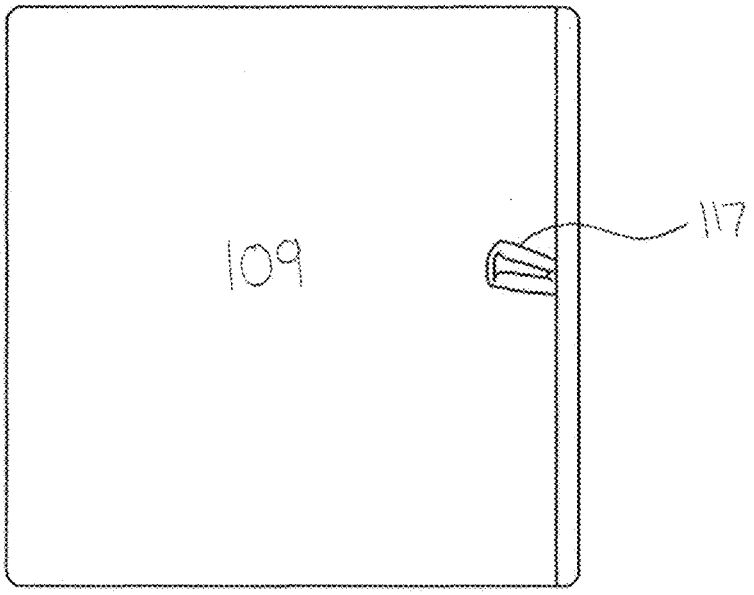
FIG. 13 depicts an example of a base insert of a storage container constructed in accordance with one or more aspects of the present disclosure.
Figure 14:
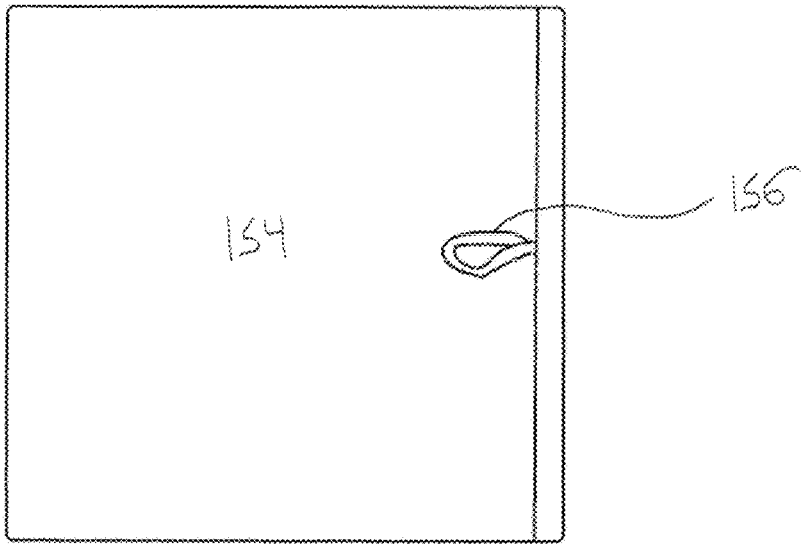
FIG. 14 depicts an example of a first divider of a storage container constructed in accordance with one or more aspects of the present disclosure.

The base 101 may be configured (e.g., shaped and/or dimensioned) to crunch, flex, bend and/or fold simultaneously with the first side wall 130 and/or the second side wall 140 to transition between the unfolded configuration 250 and the folded configuration 260. As noted above, the base 101 may be substantially rigid and/or flat, for example, to provide a foundation for the storage container 100 to sit on a shelf, table, and/or other flat surfaces. The base 101 may further function to provide a foundation for storing items, objects, or the like in the lower storage space 204. Therefore, in embodiments where the storage container 100 is collapsible, the base 101 may include a crunchable, bendable, flexible, foldable and/or otherwise collapsible foundation 105 and a substantially flat and/or rigid base insert 109 contacting the collapsible foundation 105 and providing rigidity to the collapsible foundation 105 when the storage container 100 is in the unfolded configuration 250, as shown in FIGS. 2 and 13. The base insert 109 may be removably received within the lower storage space 204. For example, the base insert 109 may be removably received on a top of the collapsible foundation 105 through the front opening 112. The base insert 109 may substantially prevent and/or prohibit the collapsible foundation 105 from collapsing when received within the lower storage space 204. Further, the base insert 109 may substantially prevent and/or prohibit the first side wall 130 and/or the second side wall 140 from collapsing inwardly towards each other when the storage container 100 is in the unfolded configuration 250 by extending rigidly therebetween. The base insert 109 may include a first handle 117 to assist the user in ergonomically controlling the base insert 109, for example, during insertion and/or removal of the base insert 109 from the lower storage space 204 through the front opening 112.

Turning again to FIGS. 2 and 9, the base insert 109 may be removed from the lower storage space 204 prior to the storage container 100 being transitioned (e.g., crunched, flexed, folded and/or bent as described above) from the unfolded configuration 250 to the folded configuration 260. For example, the user may grasp and pull the first handle 117 to lift the base insert 109 from the top of the collapsible foundation 105 and may further remove the base insert 109 from the lower storage space 204 through the front opening 112. The collapsible foundation 105 may be crunchable, flexible, bendable and/or foldable such that, once the base insert 109 has been removed from the lower storage space 204, the collapsible foundation 105 may bend, crunch, flex, and/or fold upwardly towards the first divider 150 when the storage container 100 is transitioned from the unfolded configuration 250 to the folded configuration 260. The user may perform the reverse of the above steps to reinsert the base insert 109 into the lower storage space 204 when the storage container 100 is in the open configuration 260.

As shown, for example, in FIGS. 1-2 and 9-10 the first divider 150 may also be configured (e.g., shaped and/or dimensioned) to crunch, flex, bend and/or fold simultaneously with the first side wall 130 and/or the second side wall 140. As noted above, the first divider 150 may be substantially rigid and/or flat, for example, to provide a foundation for storing items, objects, materials or the like in the upper storage space 202. Therefore, in embodiments where the storage container 100 is collapsible, the first divider 150 may include a crunchable, flexible, foldable, bendable and/or otherwise collapsible cavity or sleeve 152 and a substantially flat and/or rigid divider insert 154 removably received within (i.e., occupying or substantially occupying) the collapsible sleeve 152 and providing rigidity thereto when the storage container 100 is in the unfolded configuration 250, as shown in FIGS. 1-2, 4 and 14. For example, the divider insert 154 may be removably received within the collapsible sleeve 152 by being inserted into the collapsible sleeve 152 through a divider opening 122 in the front wall 110, the back wall 120, the first side wall 130, and/or the second side wall 140, such that the divider insert 154 substantially occupies the collapsible sleeve 152. The divider insert 154 may further include a second handle 156 to assist the user in ergonomically controlling the divider insert 154, for example, during insertion and/or removal of the divider insert 154 from the collapsible sleeve 152 through the divider opening 122. The collapsible sleeve 152 may be monolithically formed with the front wall 110, the back wall 120, the first side wall 130, and/or the second side wall 140.

As shown in FIG. 4, the divider opening 122 may extend along an outer surface 129 of the back wall 120, for example, between the first side edge 126 of the back wall 120 and the second side edge 128 of the back wall 120. The divider opening 122 may extend any distance which permits the divider insert 154 to be inserted through the divider opening 122 to substantially occupy the collapsible sleeve 152. The second handle 156 may extend outside of the collapsible sleeve 152 to be accessible from the exterior of the storage container 100 for ease of access.

The collapsible sleeve 152 may be configured (e.g., shaped and/or dimensioned) to crunch, flex, bend and/or fold inwardly to be substantially flattened when the storage container 100 is transitioned from the unfolded configuration 250 to the folded configuration 260. The divider insert 154 may therefore be removed from the collapsible sleeve 152 prior to the storage container 100 being transitioned and/or folded from the unfolded configuration 250 to the folded configuration 260. For example, the user may grasp and pull the second handle 156 to slide the divider insert 154 out from within the collapsible sleeve 152 through the divider opening 122. The collapsible sleeve 152 may crunch, flex, bend, and/or fold toward the base 101 and/or toward the upper opening 156. The user may perform the reverse of the above steps to reinsert the divider insert 154 into the collapsible sleeve 152 when the storage container 100 is in the open configuration 260.

Figure 11:
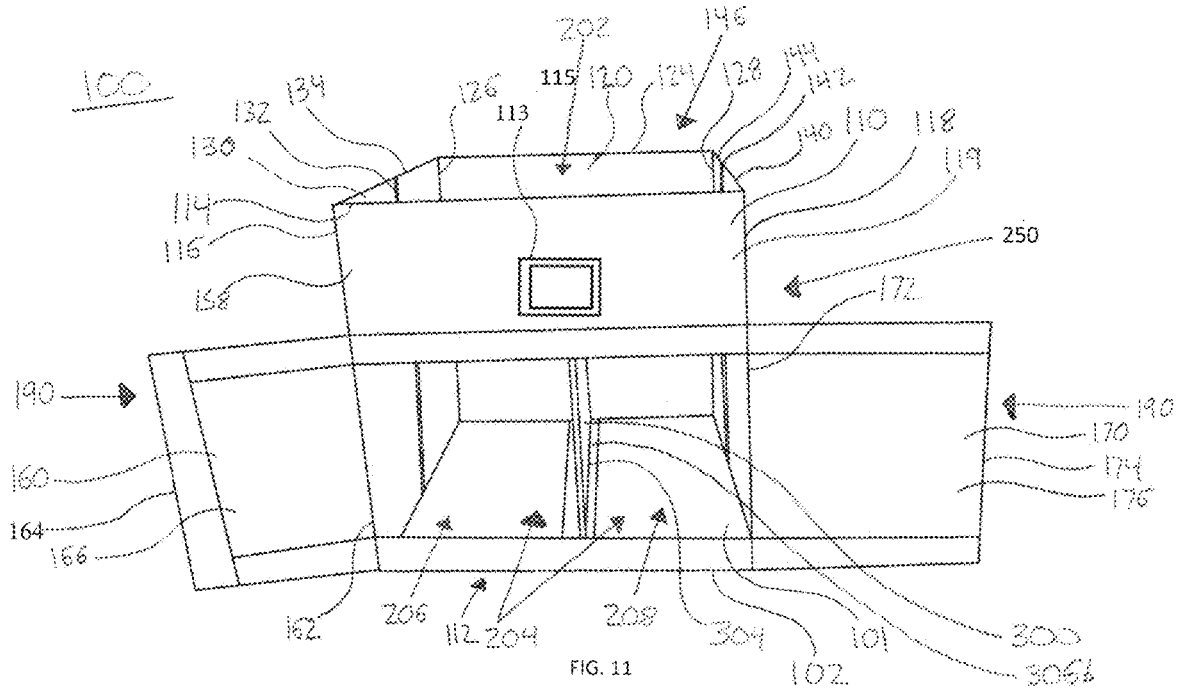
FIG. 11 depicts a perspective view of another embodiment of a storage container constructed in accordance with one or more aspects of the present disclosure with a second divider inserted in a lower storage space.
Figure 15:
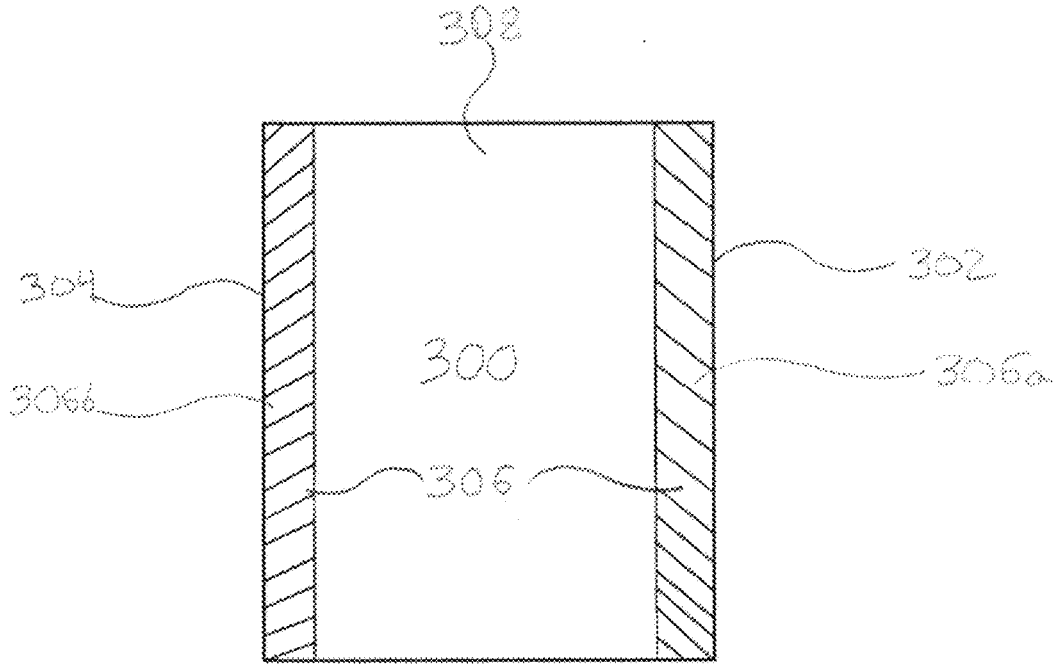
FIG. 15 depicts an example of a second divider of a storage container constructed in accordance with one or more aspects of the present disclosure.

Turning now to FIGS. 11 and 15, the storage container 100 may further include a second insert or divider 300. The second divider 300 may include a top edge 302, a bottom edge 304, a back edge 308, and at least one touch fastener 306. The at least one touch fastener 306 may extend along at least a portion of the top edge 302 and/or the bottom edge 304. In some embodiments, the touch fastener 306 may include a top fastening strip **306*a* and a bottom fastening strip 306*b* to secure the second divider 300 within the lower storage space 204. In other embodiments, only the top fastening strip 306*a* may be present to secure the second divider 300 within the lower storage space 204. In even further embodiments, another touch fastening strip (not shown) of the touch fastener 306 may extend along the back edge 308 of the second divider 300. The touch fastener 306 may be configured (e.g., shaped and/or dimensioned) to attach along a corresponding touch fastener(s) located within the lower storage space 204, for example, along the base 101 and/or the first divider 150. Alternatively, the touch fastener 306 may be configured (e.g., shaped and/or dimensioned) to attach directly to the surfaces and/or linings of the base 101 and/or the first divider 150** as described above.

The second divider 300 may be configured (e.g., shaped and/or dimensioned) to be detachably and/or removably received within the lower storage space 204, for example, through the front opening 112, such that the lower storage space 204 is partitioned, split, separated, and/or divided into a first portion 206 and a second portion 208. The user may also remove the second divider 300 from the lower storage space 204 through the front opening 112. The second divider 300 may extend vertically within the second storage space 204 between the base 101 and the first divider 150. The second divider 300 may further extend between the front wall 110 and the back wall 120. The second divider 300 may be substantially rigid to act as a barrier between the first portion 206 and the second portion 208, and may substantially prevent fluid communication between the first portion 206 and the second portion 208. The user may employ the second divider 300 to form additional storage areas (i.e., the first portion 206 and the second portion 208) for storage of a wider variety and/or different amounts of items, objects, materials, etc. The second divider 300 may be removed, for example, through the front opening 112, prior to transitioning and/or folding the storage container 100 from the unfolded configuration 250 to the folded configuration 260.

Figure 12:
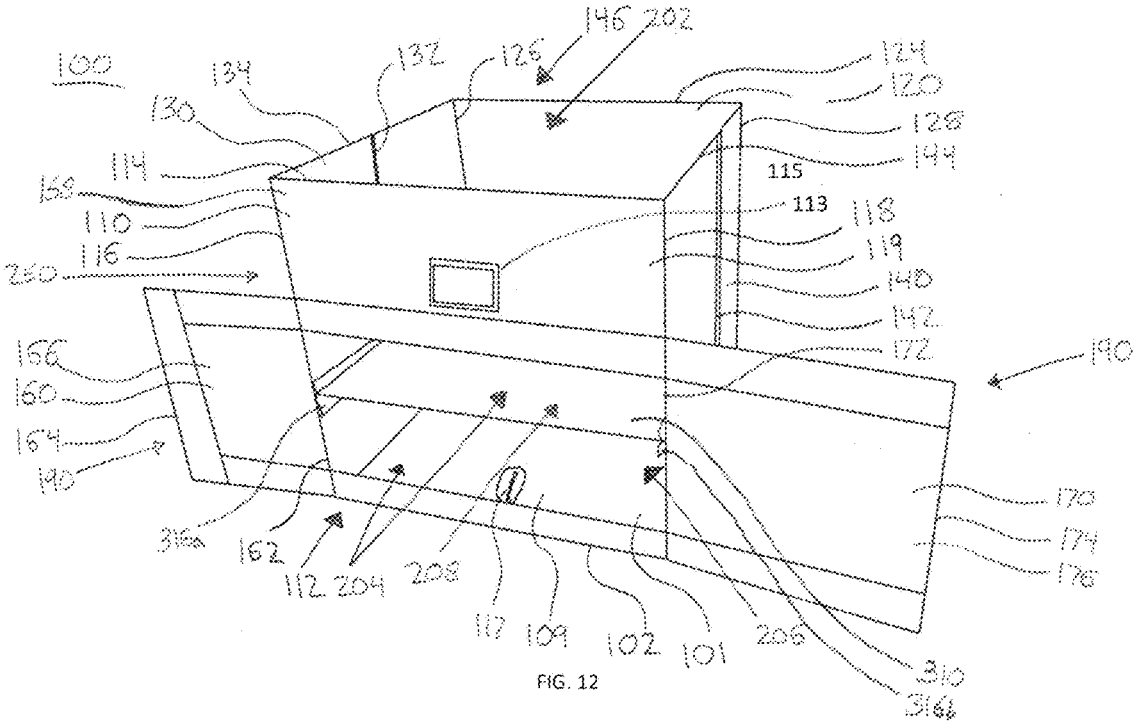
FIG. 12 depicts a perspective view of another embodiment of a storage container constructed in accordance with one or more aspects of the present disclosure with the flaps in the open position and a third divider inserted in the lower storage space.
Figure 16:
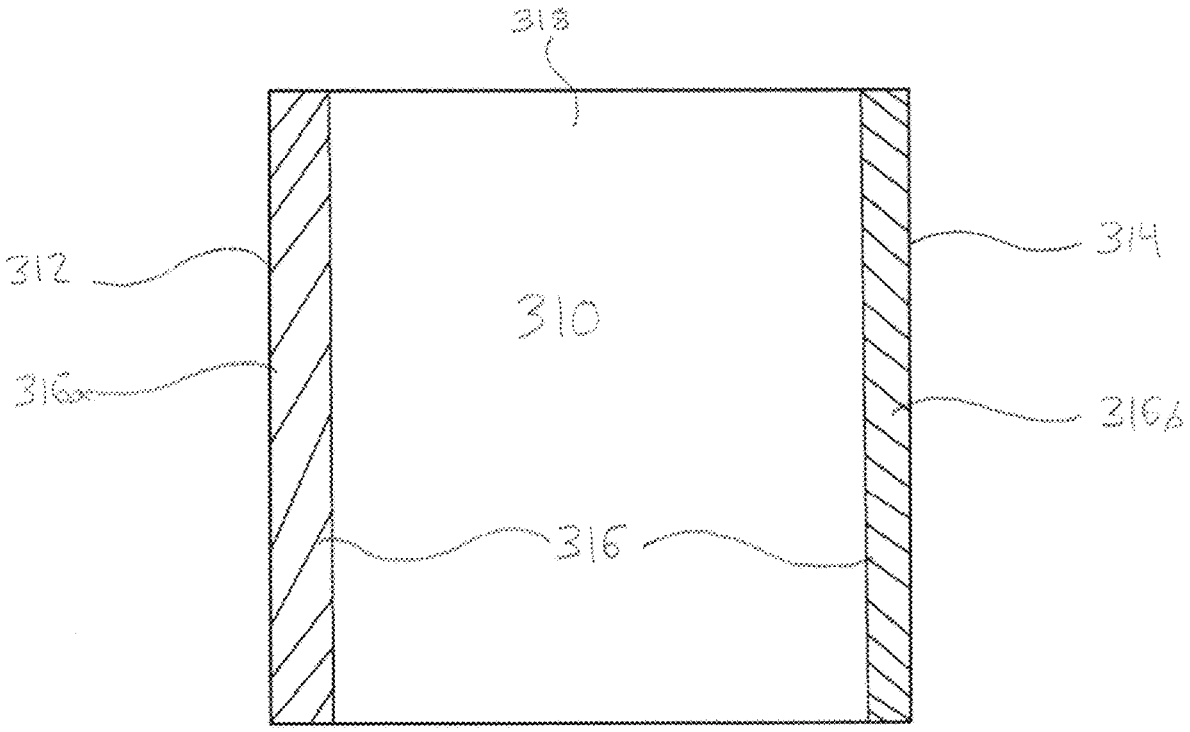
FIG. 16 depicts an example of a third divider of a storage container constructed in accordance with one or more aspects of the present disclosure.

Turning now to FIGS. 12 and 16, the storage container 100 may further include a third insert or divider 310. The third divider 310 may include a first side edge 312, a second side edge 314, a back edge 318, and at least one touch fastener 316. The at least one touch fastener 316 may extends along at least a portion of the first side edge 312 and/or the second side edge 314. In some embodiments, the touch fastener 316 may include a top fastening strip **316*a* and a bottom fastening strip 316*b* to secure the third divider 310 within the lower storage space 204. In even further embodiments, another touch fastening strip (not shown) of the touch fastener 316 may extend along the back edge 318** of the third divider 310. The touch fastener 316 may be configured (e.g., shaped and/or dimensioned) to attach along a corresponding touch fastener(s) located within the lower storage space 204, or may alternatively be configured (e.g., shaped and/or dimensioned) to attach directly to the surfaces and/or linings of the first side wall 130 and/or the second side wall 140.

The third divider 310 may be configured (e.g., shaped and/or dimensioned) to be detachably and/or removably received within the lower storage space 204, for example, through the front opening 112, such that the lower storage space 204 is partitioned, split, separated and/or divided into the first portion 206 and the second portion 208. The user may also remove the third divider 310 from the lower storage space 204 through the front opening 112. The third divider 310 may extend horizontally within the lower storage space 204 between the first side wall 130 and the second side wall 140. The third divider 310 may further extend between the front wall 110 and the back wall 120. The third divider 310 may be substantially rigid to act as a barrier between the first portion 206 and the second portion 208, and/or to act as a floor and/or foundation for items, objects, materials, etc. stored in the second portion 208; the base 101 may act as a floor and/or foundation for objects stored in the first portion 206. The third divider 310 may substantially prevent fluid communication between the first portion 206 and the second portion 208. The user may employ the third divider 310 to form additional storage areas (i.e., the first portion 206 and the second portion 208) for storage of a wider variety and/or different amounts of items, objects, materials, etc. The third divider 310 may be removed, for example, through the front opening 112, prior to transitioning and/or folding the storage container 100 from the unfolded configuration 250 to the folded configuration 260.

In some embodiments, the second divider 300 or the third divider 310 may be centered within the lower storage space 204, such that the first portion 206 and the second portion 208 may have equal volumes relative to each other. For example, the second divider 300 may be aligned along the axis Y to split the lower storage space 204 into the first portion 206 and the second portion 208. However, in other embodiments, the second divider 300 may be skewed laterally within the lower storage space 204 towards the first side wall 130 or the second side wall 140, such that the first portion 206 may have a larger volume or a smaller volume relative to the second portion 208. Similarly, in some embodiments, the third divider 310 may be skewed vertically within the lower storage space 204 towards the base 101 or the first divider 150, such that the first portion 206 may have a larger or smaller volume relative to the second portion 208. The user may choose to skew the placement of the second divider 300 and/or the third divider 310 based on the size and/or quantity of items, objects, materials, etc. to be stored in the first portion 206 and/or the second portion 208, respectively. The user may also choose the placement of the second divider 300 or the third divider 310 based on privacy concerns.

Figure 17:
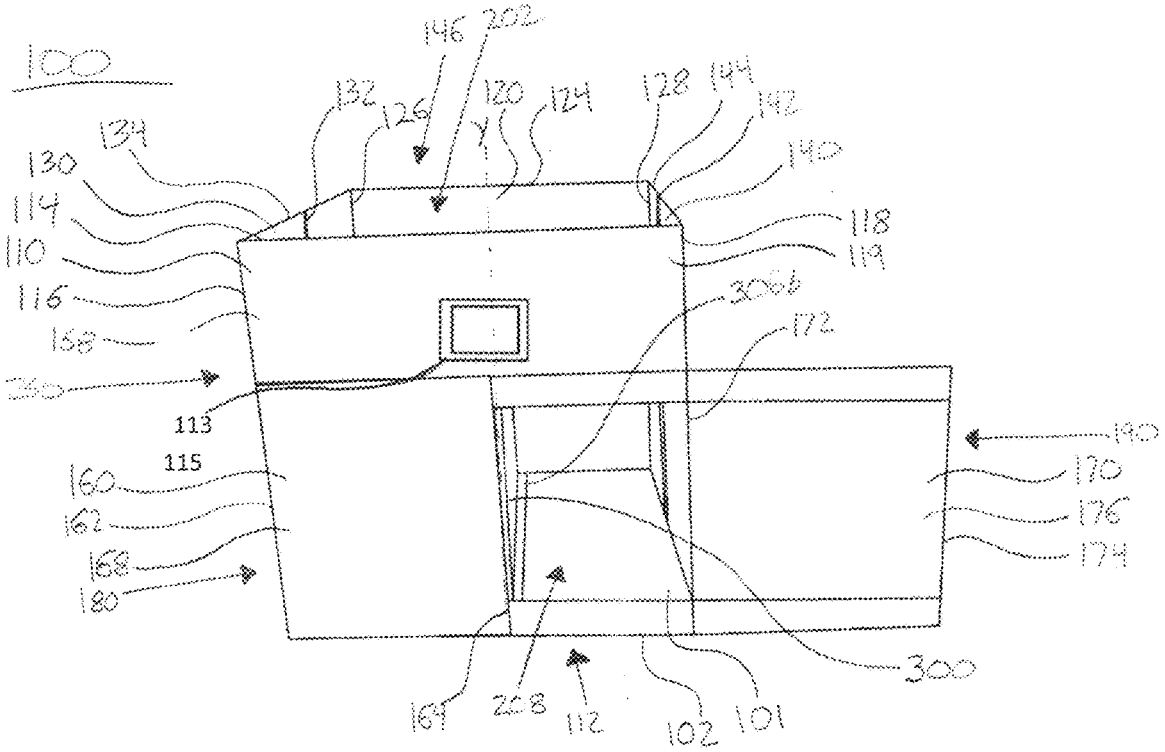
FIG. 17 depicts a perspective view of a storage container constructed in accordance with one or more aspects of the present disclosure with one flap in the open position and one flap in the closed position.

As noted above, the first flap 160 and the second flap 170 may be configured (e.g., shaped and/or dimensioned) to move independently from each other. Thus, in some embodiments, the first flap 160 may be configured (e.g., shaped and/or dimensioned) to conceal (i.e., close and/or cover) and/or reveal (i.e., uncover and/or provide access to) the first portion 206, and the second flap 170 may be configured (e.g., shaped and/or dimensioned) to conceal (i.e., close and/or cover) and/or reveal (i.e., uncover and/or provide access to) the second portion 208, as shown in FIG. 17. For example, beginning in the open position 190, the first flap 160 may be dimensioned such that, when the first flap 160 is pivoted from the open position 190 to the closed position 180 as described above, the first flap 160 only covers and/or prevents access to the first portion 206 and does not affect access to the second portion 208. Similarly, the second flap 170 may be dimensioned such that, when the second flap 170 is pivoted from the open position 190 to the closed position 180 as described above, the second flap 170 covers and/or prevents access to the second portion 208 and does not affect access to the first portion 206. Whether the first flap 160 and/or the second flap 170 are configured (e.g., shaped and/or dimensioned) to conceal and/or reveal the first portion 206 and/or the second portion 208, respectively, may depend on the placement of the second divider 300 or the third divider 300 by the user.

Figure 18:
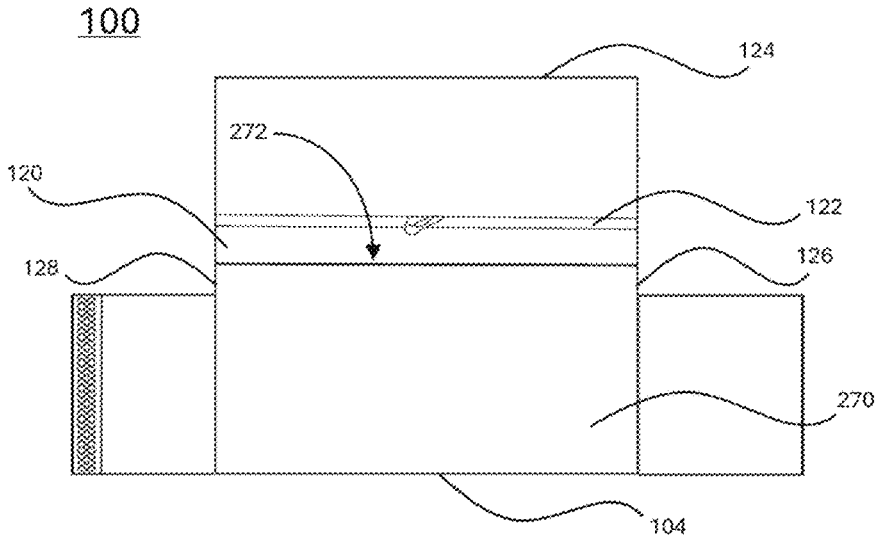
FIG. 18 depicts a back view of a storage container constructed in accordance with one or more aspects of the present disclosure with a pocket or slot on a back wall of the storage container.

In some embodiments, the storage container 100 may further include a pocket or slot 270 (e.g., a storage slot), as shown in FIG. 18. For example, the slot 270 may be located on the back wall 120 of the storage container 100 and may cover at least a portion of the back wall 120. In the example shown in FIG. 18, the slot 270 extends from the first side edge 126 to the second side edge 128 of the back wall 120. Also in the example, the slot 270 extends from a bottom of the back wall 120 (e.g., from around the back edge 104) to a location on the back wall 120 below the divider opening 122. However, in other embodiments, the slot 270 may be located in other places along the back wall 120. For example, the slot 270 may extend from around the bottom of the back wall 120 to a location on the back wall 120 above the divider opening 122 (e.g., closer to the top edge 124). In such embodiments, the slot 270 may also feature a hole and/or opening (not shown) through which the first divider 150 may be inserted to reach the divider opening 122 and/or the sleeve 152.

The slot 270 may be configured (e.g., shaped and/or dimensioned) to receive, store and/or otherwise hold any of the various dividers and/or inserts (e.g., the first divider 150, the second divider 300, the third divider 310). The slot 270 may include an opening 272 through which any of the various dividers and/or inserts may be inserted to reach an interior of the slot 270. For example, when the storage container 100 is in the folded configuration 260, one or more dividers and/or inserts may be inserted into the slot 270 through the opening 272 to store any dividers and/or inserts during transport. Further, when the storage container 100 is in the unfolded configuration 250, the storage slot 270 may be used to hold any inserts and/or dividers which are not being used to divide or otherwise partition portions of the storage area 200. For instance, when the storage container 100 is in the unfolded configuration 250, the first divider 150 may be located in the sleeve 152 as described above, and at least the second divider 300 may not be in use. In such a situation, at least the second divider 300 (and/or any other dividers) may be placed into the slot 270 for convenient storage. In some embodiments, it may further be advantageous to store flat objects, such as a folder, in the slot 270 instead of or in addition to any dividers and/or inserts.

Figure 19:
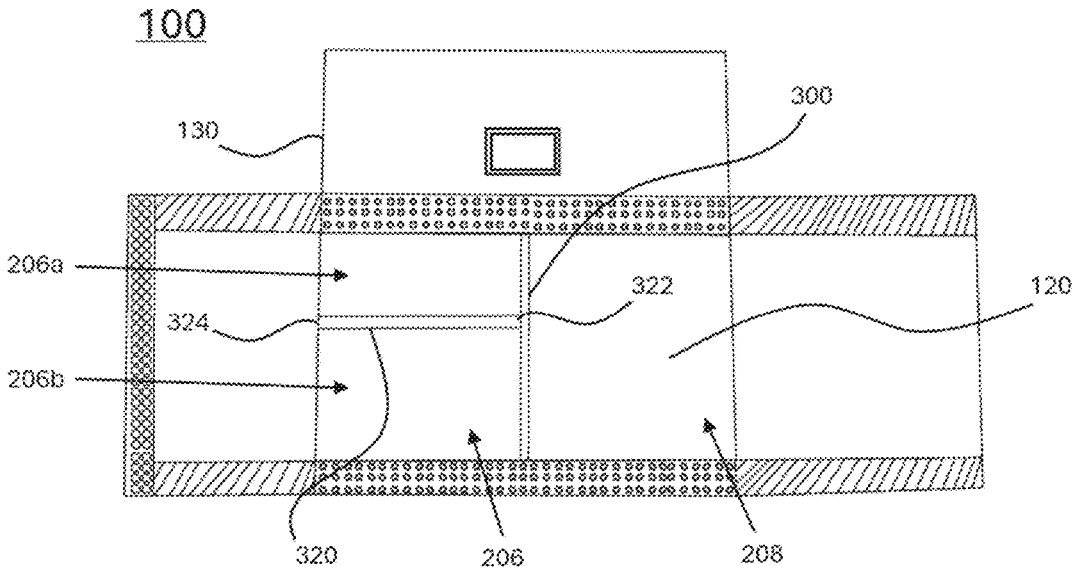
FIG. 19 depicts a front view of the storage container of FIG. 11 with a fourth divider inserted into the lower storage space.
Figure 21:
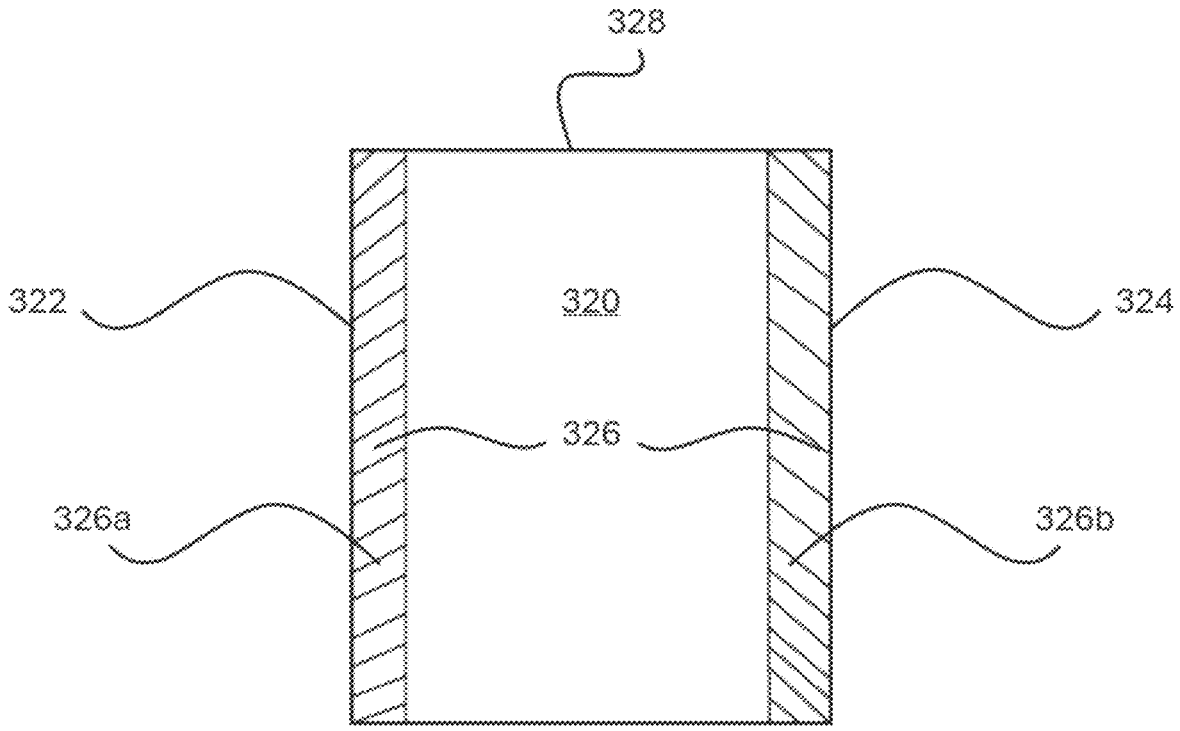
FIG. 21 depicts an example of a fourth divider and a fifth divider of a storage container constructed in accordance with one or more aspects of the present disclosure.

In some embodiments, the storage container 100 may further include a fourth divider 320, as shown in FIGS. 19 and 21. The fourth divider 320 may include a first side edge 322 and a second side edge 324, as well as at least one touch fastener 326. In the example shown in FIG. 21, the fourth divider 320 may include a first touch fastener **326*a* along at least a portion of the first side edge 322, and a second touch fastener 326***b* along at least a portion of the second side edge 324. The fourth divider 320 may further include a back edge 328.

As described above, the second divider 300 may be inserted into the lower storage space 204 to divide and/or partition the lower storage space 204 into the first portion 206 and the second portion 208 (e.g., FIG. 11). In some embodiments, the fourth divider 320 may be inserted into the lower storage space 204 after the second divider 300 has been inserted to further partitioned, split, separate, and/or divide the first portion 206 into a third portion 206*a* and a fourth portion 206*b*, as shown in FIG. 19. For example, the fourth divider 320 may be inserted into the lower storage space 204 such that the fourth divider 320 extends between the second divider 300 and the first side wall 130. The first touch fastener 326*a* may facilitate a connection between the first side edge 322 and the first side wall 130, and the second touch fastener 326*b* may facilitate a connection between the second side edge 324 and the second divider 300 to hold the fourth divider 320 in place. In the example, the fourth divider 320 may be positioned such that the back edge 328 contacts the back wall 120. When not in use, the fourth divider 320 may be stored in the slot 270 as described above.

The volumes of the third portion 206*a* and the fourth portion 206*b* of the lower storage space 204 may be adjusted by moving the fourth divider 320 up or down within the first portion 206. For example, the fourth divider 320 may be disposed in the first portion 206 closer to the first divider 150 than to the base 101 (or the base insert 109), such that the fourth portion 206*b* may be larger than the third portion 206*a*. Similarly, the fourth divider 320 may be disposed in the first portion 206 closer to the base 101 (or the base insert 109) than the first divider 150, such that the third portion 206*a* may be larger than the fourth portion 206*b*. When the fourth divider 320 is disposed in the first portion 206 directly in between the first divider 150 and the base 101 (or the base insert 109), the volumes of the third portion 206*a* and the fourth portion 206*b* may be equal. A user may choose to adjust and/or modify the relative distribution of volumes between the third portion 206*a* and the fourth portion 206*b* based on the nature and/or quantity of items to be stored therein.

Figure 20:
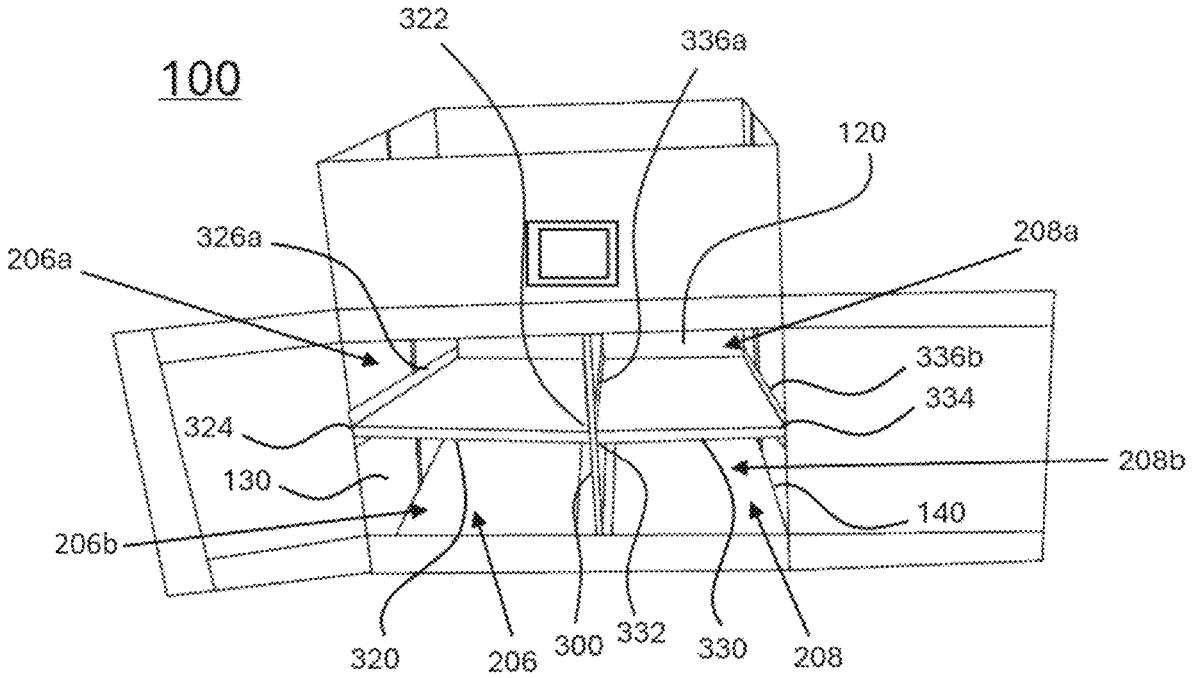
FIG. 20 depicts a top-down front perspective view of the storage container of FIG. 19 with a fifth divider inserted into the lower storage space.
Figure 22:
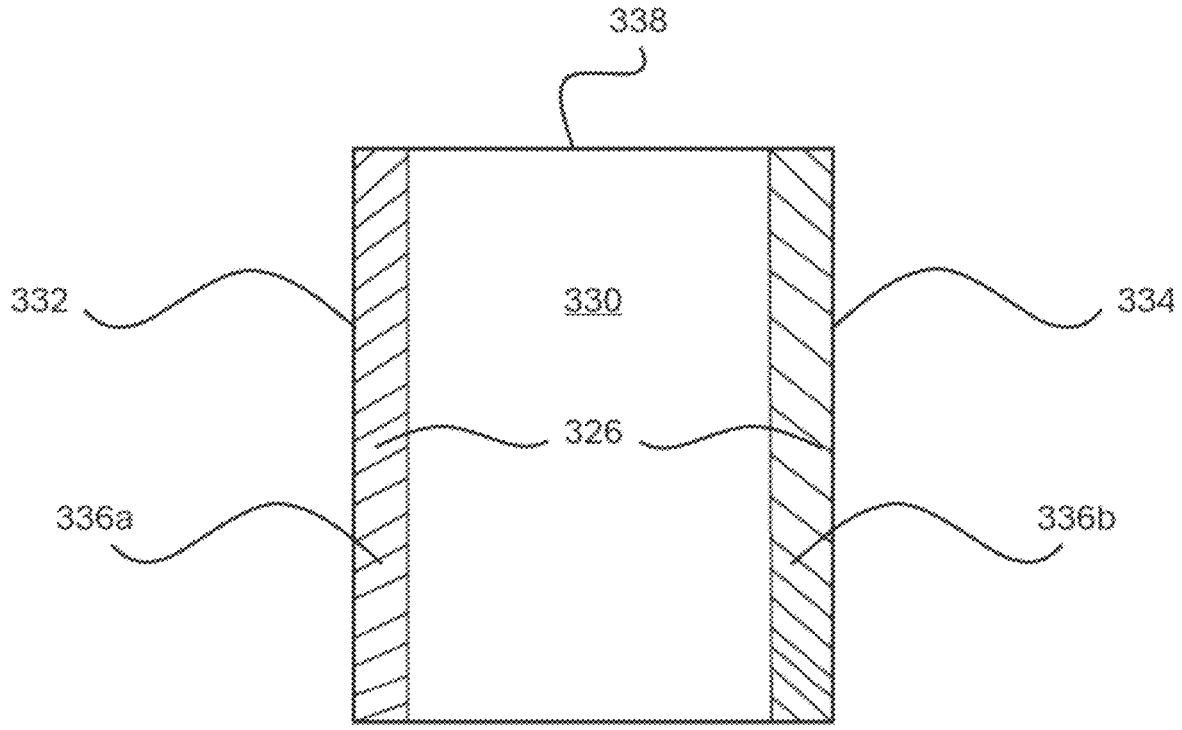

In some embodiments, the storage container 100 may further include a fifth divider 330, as shown in FIGS. 20 and 22. The fifth divider 330 may include a first side edge 332 and a second side edge 334, in as well as at least one touch fastener 336. In the example shown in FIG. 22, the fifth divider 330 may include a first touch fastener 336*a* along at least a portion of the first side edge 332, and a second touch fastener 336*b* along at least a portion of the second side edge 334. The fifth divider 330 may further include a back edge 328.

As described above, the second divider 300 may be inserted into the lower storage space 204 to divide and/or partition the lower storage space 204 into the first portion 206 and the second portion 208 (e.g., FIG. 11). As further described above, the fourth divider 320 may be inserted into the first portion 208 to divide and/or partition the first portion 206 into a third portion 206*a* and a fourth portion 206*b* (FIG. 19). Similarly, in some embodiments, the fifth divider 330 may be inserted into the second portion 208 to further partitioned, split, separate, and/or divide the second portion 208 into a fifth portion 208*a* and a sixth portion 208*b*, as shown in FIG. 20. For example, the fifth divider 330 may be inserted into the lower storage space 208 such that the fifth divider 330 extends between the second divider 300 and the second side wall 140. The first touch fastener 336*a* may facilitate a connection between the first side edge 332 and the second divider 300, and the second touch fastener 336*b* may facilitate a connection between the second side edge 334 and the second side wall 140 to hold the fifth divider 330 in place. In the example, the fifth divider 330 may be positioned such that the back edge 338 contacts the back wall 120. When not in use, the fifth divider 330 may be stored in the slot 270 as described above.

The volumes of the fifth portion 208*a* and the sixth portion 208*b* of the lower storage space 204 may be adjusted by moving the fifth divider 330 up or down within the second portion 208. For example, the fifth divider 330 may be disposed in the second portion 208 closer to the first divider 150 than to the base 101 (or the base insert 109), such that the sixth portion 208*b* may be larger than the fifth portion 208*a*. Similarly, the fifth divider 330 may be disposed in the second portion 208 closer to the base 101 (or the base insert 109) than to the first divider 105, such that the fifth portion 208*a* may be larger than the sixth portion 208*b*. When the fifth divider 330 is disposed directly in between the first divider 150 and the base 101 (or the base insert 109), the volumes of the fifth portion 208*a* and the sixth portion 208*b* may be equal. A user may choose to adjust and/or modify the relative distribution of volumes between the fifth portion 208*a* and the sixth portion 208*b* based on the nature and/or quantity of items to be stored therein.

The fourth divider 320 and the fifth divider 330 may be used interchangeably. For example, the fourth divider 320 may be used to divide the second portion 208 into the fifth portion 208*a* and the sixth portion 208*b*. Similarly, the fifth divider 330 may be used to divide the first portion 206 into the third portion 206*a* and the fourth portion 206*b*. Even more, the fourth divider 320 and the fifth divider 330 may both be inserted into the first portion 206 or the second portion 208, such that the first portion 206 or the second portion is divided into thirds. Similar dividers to the fourth divider 320 and the fifth divider 330 may also be configured (e.g., shaped and/or dimensioned) for use with the third divider 310 (e.g., FIG. 12). Such dividers (not shown) would extend between the third divider 310 and either the first divider 150 or the base 101 (or the base insert 109), depending on whether the first portion 206 or the second portion 208 is to be divided. In further embodiments, there may be more or fewer of any of the dividers discussed above, except perhaps for the first divider 150, which may be used to divide the storage area 200 into whatever portions a user may desire depending on the nature and/or quantity of items to be stored therein.

In alternative embodiments (not shown), the fourth divider 320 and the fifth divider 330 may be different sizes relative to each other. For example, the second divider 300 may be inserted into the lower storage space 204 such that the second divider 300 is offset with respect to the vertical axis Y (FIG. 17), resulting in the first portion 206 being larger than the second portions 208. In such an example, the user may employ a fourth divider 320 which is longer than the fifth divider 330, such that the fourth divider 320 may span the larger space between the second divider 300 and the first side wall 130, and the fifth divider 330 may span the smaller space between the second divider 300 and the second side wall 140. In even further embodiments (not shown), the fourth divider 320 and the fifth divider 330 may be combined. For example, the fourth divider 320 and the fifth divider 330 may be connected by and/or near corners of each of the fourth divider 320 and the fifth divider 330 which would sit closest to the front wall 110 along the vertical axis Y (FIG. 17) when the fourth divider 320 and the fifth divider 330 are inserted into the lower storage space 204. In such an embodiment, the combined fourth divider 320 and fifth divider 330 may include a slot to receive the second divider 300, such that the combined fourth divider 320 and fifth divider 330 can be placed into the lower storage space 204 around the second divider 300.

As discussed in many places above, various dividers (e.g., the second divider 300, the third divider 310, the fourth divider 320, and/or the fifth divider 330) may include touch fasteners to facilitate connections between said dividers and other components of the storage container 100, such as, without limitation, the base 101, the front wall 110, the back wall 120, the first side wall 130, the second side wall 140, the first divider 150 and the base insert 109. As also discussed above, the various components of the storage container 100 may be flatly stackable for ease of transport, such as when the storage container 100 is in the folded configuration 260. By virtue of the presence of touch fasteners on the dividers and the various materials which may be used (e.g., felt) in constructing or lining the base 101 and/or walls of the storage container 100, it may further be possible to store and/or transport the various dividers by simply stacking them, such that the various dividers are stuck or otherwise attached directly to the walls of the storage container via the touch fasteners. Thus, in some embodiments, and particularly those which lack the slot 270 (FIG. 18), the dividers may be conveniently stored and/or transported by utilizing the touch fasteners to connect the various dividers directly to the base 101 and/or walls of the storage container.

Touch fasteners are also referred to as hook and loop fasteners, hook and pile fasteners, hook and hoof fasteners, Velcro®, etc. Touch fasteners have a first fastening component and a second fastening component that are configured (e.g., shaped and/or dimensioned) to detachably and/or removably engage with, couple, connect, and/or attach to each other, for example, a hook component and a loop component, respectively. The hook and loop components are connected to opposing surfaces and/or objects that are to be coupled, attached, and/or fastened together. For example, when hook and loop components are pressed together, a densely packed plurality of small hooks catches in a densely packed plurality of small loops, fastening the hook and loop components (and the surfaces and/or objects coupled thereto, respectively) together. Other touch fasteners include, for example, systems that have double hooks for use with loops, or systems that have interlocking, opposably facing mushroom shaped connectors (e.g., Dual Lock® by 3M®), mushrooms and loops, and hooks and hooks that engage with each other. A feature of touch fasteners is that the objects and/or surfaces may be fastened and separated or unfastened (i.e., detachably and/or removably coupled and/or engaged), with the touch fasteners being reusable (i.e., the objects/surfaces may be recoupled and/or reengaged with the same touch fasteners). The term "touch fastener(s)" (and the equivalents thereof) are used herein to refer generally to any of the above forms and/or systems of touch fasteners, all of which may be interchangeably applied in combination with other aspects disclosed herein to achieve the present disclosure.

In embodiments disclosed herein, various components utilize touch/hook and loop fasteners and/or constructs for fastening (e.g., detachably and/or removably coupling, attaching, and/or engaging). The touch/hook and loop fasteners may comprise a hook component and a loop component. In some such embodiments, the hook component may be formed from a plastic material, a woven fabric material, or a combination of plastic and woven fabric materials. In some embodiments, the loop component may be formed from a plastic material, a woven fabric material, a non-woven fabric material, or velour. In some embodiments, the hook or loop portions of the touch fastener(s) have a base that is, for example, a fabric and/or plastic material. In accordance with aspects of the disclosure, other materials may be used in the base. The base is generally a flexible or bendable material. The back sides of the hook and/or loop that are opposite the operable hook and/or loop include, for example, an adhesive, a solvent, or a heat sensitive material for attaching, fastening, and/or coupling to the opposing surfaces to be connected. In some embodiments, sides of the hook and/or loop that are opposite the operable hook and/or loop include a pressure sensitive adhesive or a heat activated adhesive for attaching, fastening, and/or coupling to a surface and/or object. Other backing adhesion materials on the back side of the bases include, for example, a heat welding compound, or a solvent.

As described above, the storage container 100 may include various components which may be inserted into and/or removed from various other components, for example, the base insert 109, the first divider insert 154, the second divider 300, third divider 310, the fourth divider 320 and the fifth divider 330. These components may all be rigid and thus incapable of crunching, flexing, bending and/or folding. These components may therefore need to be removed from within the storage area 200 before transitioning the storage container 100 between the unfolded configuration 250 and the folded configuration 260. The base insert 109, the first divider insert 154, the second divider 300, the third divider 310, the fourth divider 320 and/or the fifth divider 330 may be substantially flat such that, when they are removed or otherwise not inserted into the storage area 200 as described above, these components may be flatly stackable with the other components of the storage container 100 when the storage container 100 is in the folded configuration 260. Touch fasteners which may be present on some or all of these components may secure these components to the remainder of the storage container 100 when flatly stacked, providing convenience for storage and/or transport of these components. The ability of these various components to stack flatly with one another may permit the storage container 100 to be neatly compacted for storage and/or transport of the storage container 100 when in the folded configuration 260.

As may be recognized by those of ordinary skill in the art based on the teachings herein, numerous changes and modifications may be made to the above-described and other embodiments of the present disclosure without departing from the scope of the disclosure. The components of the implants as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the storage container 100 may include more or fewer components or features than the embodiments as described and illustrated herein. For example, the components and features of FIGS. 11-12 and 15-16 may be used interchangeably and in alternative combinations as would be modified or altered by one of skill in the art. Specifically, the second divider 300 and the third divider 310 may be used in alternative combinations as would be modified or altered by one of skill in the art. In addition, the components and features of FIGS. 1-4 may be used interchangeably and in alternative combinations as would be modified or altered by one of skill in the art. Specifically, the first flap 160 and the second flap 170 may be used in alternative combinations as would be modified or altered by one of skill in the art. Accordingly, this detailed description of the currently-preferred embodiments is to be taken illustratively, as opposed to limiting of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a storage container that "comprises," "has," "includes," or "contains" one or more elements possesses those one or more elements, but is not limited to possessing only those one or more elements. Likewise, where an element "comprises," "has," "includes," or "contains" one or more features, that element possesses those one or more features, but is not limited to possessing only those one or more features. Furthermore, a structure that is configured (e.g., shaped and/or dimensioned) in a certain way is configured in at least that way, but may also be configured in ways that are not listed.

The disclosure has been described with reference to the preferred embodiments. It will be understood that the architectural and operational embodiments described herein are exemplary of a plurality of possible arrangements to provide the same general features, characteristics, and general system operation. Modifications and alterations will occur to others skilled in the art upon a reading and understanding of the preceding detailed description to accomplish the same objectives. Accordingly, it is intended that the disclosure be construed as including all such alternative aspects, modifications and alterations as fall within the true spirit and scope of the invention.

The invention claimed is:

1. A storage container, said storage container comprising:

a base, said base including a front edge, a back edge, a first side edge, and a second side edge;

a front wall extending from the front edge of said base, said front wall defining a first opening;

a back wall extending from said back edge of said base;

a first side wall extending from the first side edge of said base; and a second side wall extending from the second side edge of said base;

wherein said base, said front wall, said back wall, said first side wall and said second side wall bound a storage area, and wherein top edges of said back wall, said front wall, said first side wall, and said second side wall form a second opening; and wherein said front wall further comprises a flap and a fastening strip extending at least above or below the first opening, wherein the flap is configured to removably engage said fastening strip to cover at least a portion of said first opening.

2. The storage container of claim 1, further comprising a first divider, said first divider positioned between said base and the second opening, said first divider separating the storage area into an upper storage space and a lower storage space, wherein the second opening communicates with the upper storage space and the first opening communicates with the lower storage space.

3. The storage container of claim 1, wherein said storage container is collapsible such that, when said storage container is collapsed, a distance between said front wall and said back wall is reduced or eliminated.

4. The storage container of claim 2, wherein said base further comprises a substantially rigid lower insert configured to be removably received in the lower storage space through the first opening.

5. The storage container of claim 1, wherein said front wall further comprises a first flap having a first exposed end and a second flap having a second exposed end, wherein the first exposed end and the second exposed end are configured to removably engage each other to cover the first opening.

6. The storage container of claim 5, wherein the first flap further comprises a first pivoting end opposite the first exposed end, the first pivoting end coupled to the first side edge of the first side wall; and the second flap further comprises a second pivoting end opposite the second exposed end, the second pivoting end coupled to the first side edge of said second wall.

7. The storage container of claim 1, further comprising a pocket disposed on the back wall.

8. The storage container of claim 1, wherein the at least one flap further comprises a pivoting end coupled to the first side edge of said first side wall or the first side edge of said second side wall.

9. The storage container of claim 2, further comprising a second divider removably received within the lower storage space and extending vertically between said base and said first divider to separate the lower storage space into a first portion and a second portion.

10. The storage container of claim 9, further comprising a third divider removably received within the lower storage space and extending horizontally between said second divider and said first side wall or said second side will to separate the first portion or the second portion into a third portion and a fourth portion.

11. The storage container of claim 2, further comprising a second divider removably received within the lower storage space and extending horizontally between said first side wall and said second side wall to separate the lower storage space into a first portion and a second portion.

12. The storage container of claim 11, further comprising a third divider removably received within the lower storage space and extending vertically between said second divider and said base or said first divider to separate the first portion or the second portion into a third portion and a fourth portion.

13. The storage container of claim 1, wherein the front wall further comprises at least one flap having a first exposed end and a first pivoting end, the at least one flap pivotable about the first pivoting end to cover or expose at least a portion of the first opening.

14. The storage container of claim 2, further comprising a third opening on an exterior surface of said back wall, said front wall, said first side wall, or said second side wall, and wherein said first divider further comprises:

a cavity in fluid communication with the third opening, the cavity extending from the third opening through a center of said first divider; and a substantially rigid upper insert configured to be removably received within the cavity through the third opening such that the upper insert substantially occupies the cavity.

15. A storage container comprising:

a lower base connected to a front wall having a first opening, a back wall opposite the front wall, a first side wall extending on a first side of said lower base between said front wall and said back wall, and a second side wall extending on a second side of said lower base between said front wall and said back wall;

wherein said lower base, said front wall, said back wall, said first side wall and said second side wall bound a storage area; and an upper base comprising:

a second opening in an outer face of said front wall, said back wall, said first side wall or said second side wall, wherein the storage container further comprises a sleeve extending from the second opening, the sleeve extending between said back wall and said front wall, and between said first side wall and said second side wall, said sleeve dividing the storage area into an upper storage space above said sleeve and a lower storage space below said sleeve;

wherein the lower storage space is accessible through the first opening.

16. A collapsible storage container system comprising:

a storage container including:

a base and a plurality of walls extending from said base, said plurality of walls being connected to the base and bounding a storage area; and at least one divider configured to separate the storage area into a first storage space and a second storage space;

wherein said plurality of walls include a front wall defining a first opening to the first storage space, and wherein top edges of said plurality of walls define a second opening to the second storage space;

wherein the base and at least some walls of the plurality of walls are configured to fold inwardly towards a center of the storage container to transition the storage container between an open configuration and a folded configuration.

17. The collapsible storage container system of claim 16, further comprising:

at least one insert configured to be inserted into the first storage space to divide the first storage space into a first storage compartment and a second storage compartment.

18. The collapsible storage container system of claim 16, wherein the at least one divider includes a cavity, and wherein at least one wall of the plurality of walls includes a third opening to the cavity; and wherein the collapsible storage container system further comprises at least one insert configured to be inserted into the cavity through the third opening to provide rigidity to the at least one divider.

* * * * *